United States Patent [19]

Prasad

[11] Patent Number: 5,072,771

[45] **Date of Patent: * Dec. 17, 1991**

[54] METHOD AND APPARATUS FOR CASTING A METAL ARTICLE

[75] Inventor: T. V. Rama Prasad, Mentor, Ohio

[73] Assignee: PCC Airfoils, Inc., Cleveland, Ohio

[ * ] Notice: The portion of the term of this patent subsequent to Mar. 7, 2006 has been disclaimed.

[21] Appl. No.: 478,251

[22] Filed: Feb. 9, 1990

Related U.S. Application Data

[63] Continuation-in-part of Ser. No. 312,044, Feb. 16, 1989, which is a continuation-in-part of Ser. No. 174,007, Mar. 28, 1988, Pat. No. 4,809,764.

[51] Int. Cl.[5] ..... B22D 27/04; B22C 9/20

[52] U.S. Cl. ..... 164/122.1; 164/125; 164/127; 164/350; 164/352; 164/359

[58] Field of Search ..... 164/122, 122.1, 122.2, 164/125, 127, 338.1, 349, 350, 348, 352, 361, 359, 123

[56] References Cited

U.S. PATENT DOCUMENTS

| | | | |
|---|---|---|---|
| 2,822,308 | 2/1958 | Hall | 164/122.2 |
| 3,680,625 | 8/1972 | Hein | 164/122.1 |
| 3,690,368 | 9/1972 | Copley et al. | 164/122.2 |
| 3,700,023 | 10/1972 | Giamei | 164/122.2 |
| 3,931,847 | 1/1976 | Terkelsen | 164/122.1 |
| 4,609,029 | 9/1986 | Vishnevsky | 164/122.1 |
| 4,724,891 | 2/1988 | Brookes | 164/34 |
| 4,809,764 | 3/1989 | Prasad | 164/127 |
| 4,819,709 | 4/1989 | Lallement | 164/122.1 |
| 4,850,419 | 7/1989 | Blazek | 164/122.1 |

FOREIGN PATENT DOCUMENTS

| | | | |
|---|---|---|---|
| 3039935 | 5/1982 | Fed. Rep. of Germany | 164/359 |

*Primary Examiner*—Richard K. Seidel
*Assistant Examiner*—Rex E. Pelto
*Attorney, Agent, or Firm*—Tarolli, Sundheim & Covell

[57] ABSTRACT

A long thin metal article having a thick portion is cast with a stress free interconnection between the thick and thin portions of the article. A heat transfer wall is provided around at least a portion of a mold in which the article is cast. To preheat the mold, heat is radiated from an inner side surface of a furnace wall to an outer side surface of the heat transfer wall. Heat is radiated from an inner side surface of the wall to the mold. Molten metal is conducted into the long thin portion of the article mold at a location other than along the length of the long thin portion of the article mold. During solidification of the molten metal, heat is radiated from the thick portion of the article mold to the inner side surface of the heat transfer wall. As the mold structure is withdrawn from the furnace chamber during solidification of the molten metal in the article mold cavity, heat is radiated from the outer side surface of the heat transfer wall to locations outside of the furnace. The presence of the heat transfer wall promotes a stress free solidification of the molten metal in the portion of the article where the thick and thin portions are interconnected.

38 Claims, 8 Drawing Sheets

202
140
46a
144
48a
112a
114a
84a
76a
38a
174
82a
184
178
176
182
12
180
208
164
12
188
206
186
190

METHOD AND APPARATUS FOR CASTING A METAL ARTICLE

BACKGROUND OF THE INVENTION

This application is a continuation-in-part of U.S. patent application Ser. No. 312,044 filed Feb. 16, 1989. The aforementioned U.S. patent application Ser. No. 312,044 is, itself, a continuation-in-part of U.S. patent application Ser. No. 174,007, filed Mar. 28, 1988, now U.S. Pat. No. 4,809,764. The benefit of the earlier filed patent applications Ser. Nos. 312,044 and 174,007 has been and hereby is claimed for any common subject matter.

The present invention relates to a method and apparatus for use in casting a metal article. The method and apparatus may advantageously be used in casting a metal article having thick and thin portions.

Prior to the making of the invention disclosed in U.S. Pat. No. 4,809,764, the investment casting of long, thin articles required more than one feeder to obtain the required casting soundness. This is because of limitations on the distance over which any feeder had been observed to feed effectively. The provision of a plurality of feeders over the length of a long thin casting promotes the formation of defects in the casting.

The casting of long thin articles becomes particularly difficult when a relatively thick section, such as a boss, rail or shroud, is provided at one end of the article. In the past, these relatively thick portions have required a separate feeder or a blind feeder. The use of an additional feeder increases the cost of forming the casting due to several process operations, such as wax assembling, manufacture of shells, cutoff and finishing operations on the casting.

When a mold for casting an article has a thick lower end portion with a thin portion extending upwardly therefrom, difficulties have been encountered in forming a stress free interconnection between the thick and thin portions of the article. Thus, stresses are frequently induced at the interconnection between the thick and thin portions of a cast article due to different cooling rates and shrinkage of the metal during solidification. When the molten metal in an article mold cavity is solidified by withdrawing the thick and thin portions of the article mold from a furnace chamber, a relatively high rate of heat transfer is immediately established between the portion of the mold structure withdrawn from the furnace chamber and the environment surrounding the furnace. This results in a relatively high rate of cooling of both the thick portion of the article mold and the thin portion of the article mold. Due to the high rate of cooling of the thick and thin portions of the article mold, stresses and/or hot tears tend to be induced in the article as the molten metal solidifies.

SUMMARY OF THE INVENTION

The present invention relates to a new and improved method and apparatus for use in casting a metal article which is long and thin and/or has a thin portion connected with a thick portion. The formation of a stress-free interconnection between the thick and thin portions of the cast article is promoted by the use of a transfer wall which extends around the article mold.

During preheating of the mold, heat is radiated from an inner side surface of a furnace chamber to an outer side surface of the heat transfer wall which extends around the article mold. Heat is radiated from an inner side surface of the heat transfer wall to the article mold.

During solidification of the molten metal in the mold, heat is radiated from the article mold to the inner side surface of the heat transfer wall and is radiated outwardly from the outer side surface of the heat transfer wall. The use of the heat transfer wall is particularly advantageous when the mold is withdrawn from the furnace chamber during solidification of the molten metal. This is because the wall retards the transfer of heat from the mold and promotes the maintenance of relatively uniform temperature gradients along the length of the mold.

Accordingly, it is an object of this invention to provide a new and improved method and apparatus for use in casting a metal article and wherein a wall extends around a mold to promote the stress-free solidification of molten metal in the mold.

Another object of this invention is to provide a new and improved method and apparatus wherein heat is radiated from a mold structure to a wall and from the wall to areas outside of a furnace during withdrawal of the mold from the furnace.

Another object of this invention is to provide a new and improved method and apparatus wherein a mold is heated by radiating heat from a furnace to a wall extending around the mold and radiating heat from the wall to the mold.

Another object of this invention is to provide a new and improved method and apparatus in accordance with any of the preceding objects and wherein at least a portion of the article is long and thin and has a length which is more than four inches and which is at least twenty times its thickness.

BRIEF DESCRIPTION OF THE DRAWINGS

The foregoing and other objects and features of the present invention will become more apparent upon a consideration of the following description taken in connection with the accompanying drawings, wherein.

DESCRIPTION OF SPECIFIC PREFERRED EMBODIMENTS OF THE INVENTION

Metal Article

Figure 1:
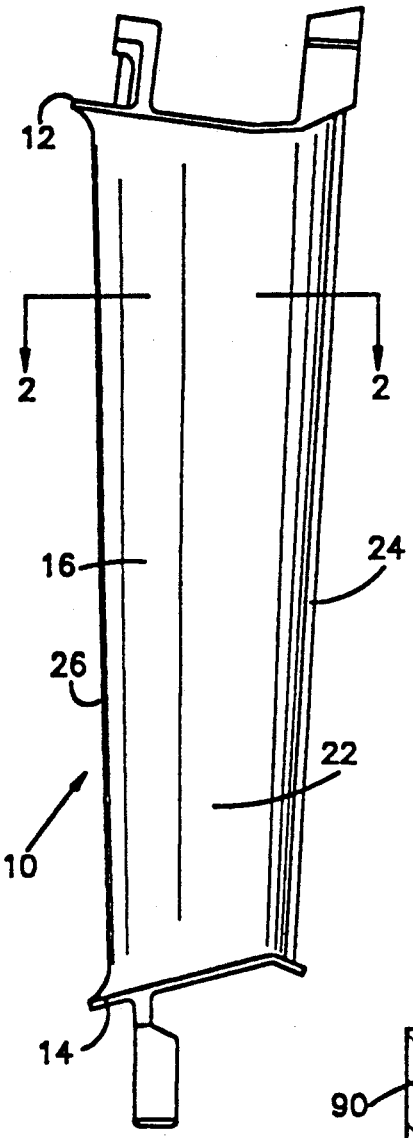
FIG. 1 is an elevational view of a metal article having a long thin portion.

A metal article 10 having a long thin portion is illustrated in FIG. 1. Although the present invention could be utilized to cast many different articles, the article 10 is a vane for use in a jet engine. Due to the relatively severe operating conditions to which the vane 10 is exposed, it is formed of a nickel chrome superalloy. The vane 10 has an equiaxed grain structure.

The vane or metal article 10 has an upper shroud portion 12 and a lower shroud portion 14. A long thin airfoil portion 16 extends between and is cast as one piece with the upper and lower shroud portions. The vane 10 has a length of approximately 8.25 inches. The airfoil portion 16 of the vane 10 has a length of approximately seven inches.

The airfoil portion 16 of the vane 10 has a width of approximately 2.5 inches. Thus, the distance between the leading edge portion 24 (FIG. 2) of the vane 10 and a trailing edge portion 26 of the vane, as measured along a central axis 28, is approximately 2.5 inches. Since the airfoil portion 16 of the vane 10 has a slight longitudinal taper, the distance between the leading and trailing edge portions 24 and 26 varies along the length of the vane 10. The airfoil portion 16 of the vane 10 has a maximum thickness of approximately 0.080 inches. The airfoil portion 16 of the vane 10 gets thinner toward the leading and trailing edge portions 24 and 26.

The generally rectangular shroud sections 12 and 14 of the one piece vane 10 are substantially thicker than the airfoil portion 16. Thus, the shroud sections 12 and 14 have a width of approximately an inch and a half and a height of approximately five eighths of an inch. It should be understood that the vane 10 could have a configuration other than the specific configuration illustrated in FIGS. 1 and 2. For example, one or both shroud sections 12 and 14 could be omitted if desired. Although the vane 10 is formed of a nickel chrome superalloy, it is contemplated that blades, vanes or other articles cast in accordance with the method of the present invention may be formed of different metals. For example, articles which are long and thin or have portions which are long and thin may be cast of cobalt based alloys or iron based alloys. However, it is believed that the present invention will be particularly advantageous in the casting of nickel chrome superalloy blades and vanes.

The airfoil portion 16 of the vane 10 is a long thin article. Thus, the airfoil portion 16 of the vane 10 has a length (FIG. 1) of more than four inches. The length of the airfoil portion 16 of the vane 10 is also at least twenty times the thickness of the airfoil portion. Therefore, the airfoil portion 16 of the vane 10 meets the requirements for what is referred to herein as a long thin article. The specific vane 10 illustrated in FIGS. 1 and 2 has an airfoil portion 16 with a length which is approximately eighty-seven times the thickness of the airfoil portion.

Figure 3:
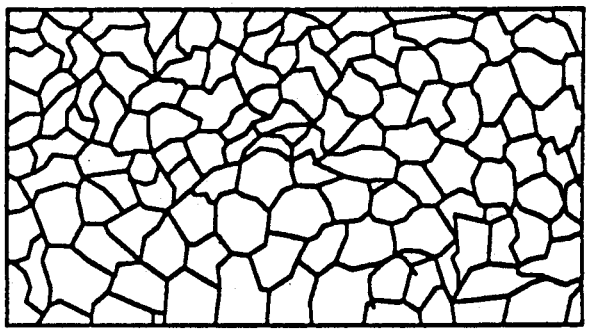
FIG. 3 is a greatly enlarged view illustrating equiaxed grains of the cast article of FIGS. 1 and 2.

The vane 10 has an equiaxed grain structure which is illustrated in FIG. 3. Thus, the vane 10 has numerous randomly orientated grains which are the result of random nucleation and grain growth during solidification of the molten metal forming the vane 10. The surface grains have a maximum dimension of one half of an inch or less. Although long thin blades and/or vanes have been formed with columnar grain structure or as a single crystal, conditions at certain locations in a jet engine are such as to make the use of an equiaxed grain structure the most economical.

Casting The Article

When casting an equiaxed metal article which is relatively long and thin or which has a portion which is long and thin, that is an article or a portion of an article having a length which is more than four inches and which is at least twenty times its thickness, it is customary to provide gates or passages at a plurality of locations along the length of the article. The customary gates or passages conduct molten metal to the long thin portion of the mold cavity during filling of the mold cavity with molten metal. The gates or passages also conduct molten metal to the long thin portion of the mold cavity to compensate for shrinkage of the metal as it solidifies.

Figure 2:
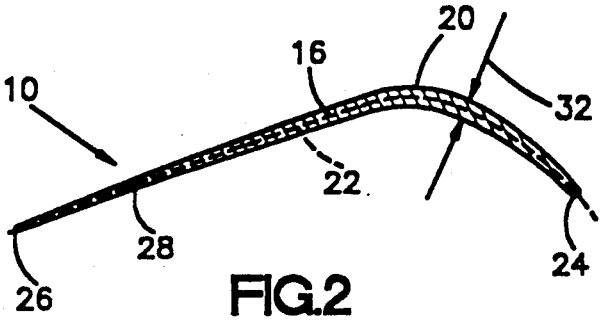
FIG. 2 is a sectional view, taken generally along the line 2—2 of FIG. 1, further illustrating the configuration of the long thin portion of the metal article.

When conventional casting practices were used in an attempt to cast a vane similar to the vane 10 of FIGS. 1 and 2, four gates were used. The gates were spaced apart along the convex side of the long thin portion of the mold cavity in which the airfoil portion 16 was to be cast. This particular vane had a long thin airfoil portion with a length of 11 inches and a maximum thickness of 0.120 inches. Of course, the number of gates which conventional practice indicates should be used will vary depending upon the type of mold, the metal being cast, and many other factors.

The use of a relatively large number of gates during the casting of a long thin article of equiaxed metal, such as the vane 10, substantially increases the cost of producing the article. The metal which solidifies in the gates is scrap which, in the case of expensive alloys, can contribute significantly to the cost of the article. In addition, the gates frequently result in casting defects, such as excessively large grains, hot tears and/or distortion.

When gates are connected with a curved surface in a mold, a stub end portion of the gate must be carefully ground away. The grinding must be carefully performed in order to provide the cast article with a continuous surface having the desired curvature. Thus, the grinding away of gate stubs from major side surfaces 20 and 22 of the airfoil 10 would be a laborious and time consuming process.

In accordance with one of the features of the present invention, no gates were used along the length of the long thin portion of the mold cavity in which the vane 10 of FIGS. 1 and 2 was cast with an equiaxed grain structure. Thus, an article mold 38 (FIG. 4) having only a single inlet at its upper end was used to cast the vane 10. There are no gates along the sides of the article mold 38. However, it is contemplated that a blind riser or a gate could be provided at the lower end of the article mold if desired. The casting process was conducted in such a manner as to result in the vane 10 having a fine equiaxed grain structure, similar to the grain structure shown in FIG. 3. The vane 10 was free of shrinkage defects, hot tears and distortion.

For reasons of economy, it is preferred to cast a plurality of the vanes at a time. Therefore, a one piece mold structure 42 is used to cast a plurality of the vanes at a time. The mold structure 42 includes a circular array of twelve article molds 38. It should be understood that although only two article molds 38 have been shown in FIG. 4, the mold structure 42 may have eight, twelve, sixteen, or more article molds 38 disposed in an annular array or cluster about a solid support post 44.

A pour cup 46 is supported on an upper end of the support post 44. A plurality of gates or runners 48 extend outwardly from the pour cup 46 with one runner going to each article mold 38. The article molds 38 are supported on a circular base plate 52 by ceramic spacer blocks 54 having a height of three eights to one and one half inches. The spacer blocks 54 support the closed lower end portions of the article molds 38. The spacer blocks could be eliminated or could have different dimensions if desired.

When the mold structure 42 is to be made, a wax pattern is assembled. The wax pattern includes a plurality of article patterns having the same configuration as the configuration of the article to be cast, that is the same configuration as the vane 10. The article patterns did not have any gate patterns disposed along the length of the article patterns.

The wax patterns of the articles, that is, the vanes 10, are connected with wax patterns having a configuration corresponding to passages in the gates or runners 48. There is only one gate or runner passage pattern connected to the upper end of each vane pattern. The runner passage patterns are in turn connected with a pattern corresponding to the shape of the inside of the hollow pour cup 46. A ceramic spacer block 54 is connected with a lower end of each vane pattern. A ceramic support post extends between the pour cup pattern and a wax pattern of the base plate 52.

The entire pattern assembly is repetitively dipped in a slurry of ceramic mold material and stuccoed to build up a layer of mold material over the pattern assembly. Once a layer of desired thickness has been built up over the pattern assembly, the layer is dried. The wax pattern material is then melted and removed from the ceramic layer by the use of heat and/or chemical solutions. The ceramic mold material is then fired to give it the requisite strength and complete the process of forming the mold structure 42.

The process of making a mold structure similar to the mold structure 42 by the foregoing process is well known. However, it should be noted that the wax pattern and the resulting mold structure does not have any provision for gating passages to side portions of the article molds 38. The only passages for conducting molten metal to the article molds 38 from the pour cup 46 are in the runners 48.

When vanes or articles 10 are to be cast, the mold structure 42 is placed on a circular water cooled copper chill plate 60. Although the closed lower ends of the article molds are close to the chill plate 60, they are separated from the chill plate by three eights to one and one half inches of ceramic material. The longitudinal central axes of article mold cavities in the article molds 38 are perpendicular to a horizontal upper side surface 62 of the chill plate 60.

A motor (not shown) then moves a cylindrical support post 64 for the chill plate 60 vertically upwardly. As the chill plate 60 moves upwardly, the mold structure 42 enters a chamber or housing (not shown) which encloses a furnace 68. Continued upward movement of the chill plate 60 moves the mold structure 42 into a cylindrical furnace chamber 72. The housing enclosing the furnace 68 is then evacuated and the mold structure 42 preheated.

The furnace preheats the mold structure 42 in a non-uniform manner. Thus, there is a temperature gradient which increases from a low temperature at the lower end of the article molds 38 to a higher temperature at the upper ends of the molds. An imaginary horizontal plane 76 extends through the centers of the long thin portions of the article molds 38 and divides the long thin portions of the article molds into a lower half 82 and an upper half 84.

The lower half 82 of the long thin portions of each of the article molds 38 is heated into a first temperature range. The highest temperature in this first temperature range is close to but is less than the solidus temperature of the metal of the vane 10. The upper half of the long thin portions of each of the article molds 38 is heated into a second temperature range. The second temperature range contains temperatures which are higher than the temperatures in the first temperature range. Since the upper and lower halves 82 and 84 of the long thin portions of the article molds 38 are separated by only an imaginary plane 76, the lowest temperature in the second temperature range into which the upper half 84 is heated is the same as the highest temperature of the temperature range into which the lower half 82 is heated.

The highest temperature of the second temperature range into which the upper half 84 of a long thin portion of an article mold 38 is heated is close to the solidus temperature of the molten metal of the vane 10. The highest temperature to which the upper half 84 of a long thin portion of an article mold 38 is heated may be somewhat greater than the solidus temperature of the metal of the vane 10 or somewhat less than the solidus temperature of the metal of the vane 10. Due to many different factors, the vertical temperature gradient along the mold 38 will probably not increase in exactly a uniform manner from the lower end of an article mold 38 to the upper end of the article mold. However, the temperature gradient will probably be similar to a uniform temperature gradient. It should be understood that the lower end of the article mold 38 is preheated to the lowest temperature and the upper end of the article mold is preheated to the highest temperature.

Preheating the lower half 82 to a temperature which is less than the temperature of upper half 84 is facilitated by having the mold structure 42 supported by the chill plate 60. In addition, helical coils 90, 92 and 94 are energized to different extents to further promote the desired temperature gradient. Thus, the amount of electrical energy which is conducted to the coil 90 is greater than the amount of electrical energy conducted to the coil 92. The amount of electrical energy conducted to the coil 92 is greater than the amount of electrical energy conducted to the coil 94. The differential energization of the coils 90-94 results in a differential in the heat energy transmitted through a graphite susceptor 96 to the article molds 38.

Although it is preferred to establish the temperature gradient between the upper and lower ends of the article molds 38 by the combined effect of the chill plate 60 and differential energization of the induction coils 90-94, the temperature gradient could be established by the use of baffles. Thus, a cylindrical baffle could be provided around the lower portion of the circular array of article molds 38. In addition, one or more annular baffles could extend radially inwardly from the cylindrical susceptor 96 to promote the establishment of a temperature gradient. Other baffle arrangements could be used if desired.

The coils 90, 92 and 94 are surrounded by a cylindrical furnace wall 98. An annular ceramic ring 100 is disposed adjacent to the lower end of the furnace wall 98. The susceptor 96 is seated on and supported by the ceramic ring 100. Of course, the furnace 68 could have a construction which is different than the specific construction shown in FIG. 4.

Regardless of how the temperature gradient is established, the upper end of a preheated article mold 38 is hotter than the lower end of the article mold. The temperature of the upper end of the long thin portion of a preheated article mold 38 is close to but may be either above or below the solidus temperature of the metal of the vane 10. The lower end of the long thin portion of the preheated article mold 38 is at a temperature which is approximately 50 to 500 degrees Fahrenheit less than the temperature of the upper end of the long thin portion of the article mold.

Once the article molds 38 have been preheated in the foregoing manner, molten metal is poured through an opening 102 in a circular upper end wall 104 of the furnace 68 into the pour cup 46. At the time of pouring, the molten metal is superheated by 50 to 400 degrees Fahrenheit. The pouring of the molten metal occurs in the vacuum chamber or housing which surrounds the furnace 68. Although it is preferred to fill the article mold cavity from only a single runner or gate 48 connected in fluid communication with the upper end of the article mold cavity, a second runner or gate could be connected with the lower end of the article mold cavity if desired.

Since seventy to one hundred percent of the length of each of the long thin portions of the article molds 38 is below the solidus temperature of the molten metal, random nucleation occurs over almost the entire surface of each article mold cavity when the molten metal is poured into the article molds. Although the exact extent of nucleation on the surfaces of the article mold cavities is not known, it is believed that nucleation and, therefore, initiation of solidification of the molten metal, occurs at locations which are disposed along at least the lower eighty to ninety percent of the long thin portion of each article mold cavity. This nucleation may be promoted by the presence of an inoculant in the molten metal.

As soon as the article molds 38 are filled with molten metal, withdrawal of the mold structure 42 from the furnace 68 begins. The rate of withdrawal of the mold structure 42 from the furnace 68 into the vacuum chamber surrounding the furnace is relatively high, that is 60 to 120 inches per hour. However, slower mold withdrawal speeds have also been used. Withdrawal of the mold assembly 42 from the furnace 68 is accomplished by lowering the chill plate 60 and its support post 64 at a constant speed. However, the speed of withdrawal of the mold structure 42 could be varied as the mold is withdrawn from the furnace.

Figure 5:
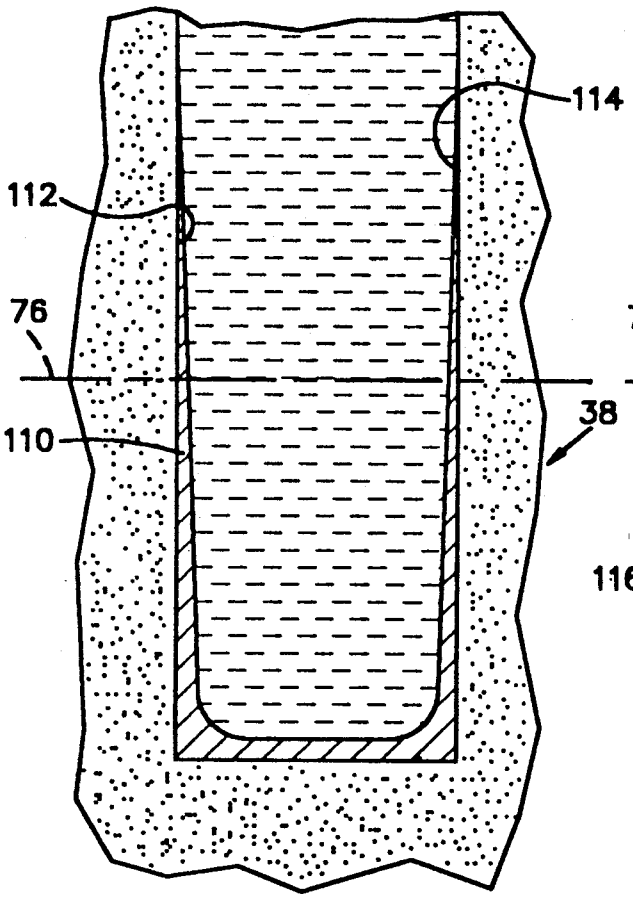
FIG. 5 is a schematicized sectional view of an article mold cavity of the mold structure of FIG. 4 and illustrating the manner in which molten metal initially solidifies along a large majority of the surface area of the long thin portion of the article mold cavity.

As an article mold 38 is withdrawn from the furnace 68, a thin, discontinuous layer or skin 110 (FIG. 5) of equiaxed metal solidifies over a large majority of an inner side surface 112 of the long thin portion of an article mold cavity 114. Although it can only be hypothesized, it is believed that the thin layer 110 extends over all but the upper two to ten percent of the inner side surface 112 of the long thin portion of the article mold cavity 114. The metal layer 110 has an equiaxed grain structure (FIG. 3) with a maximum grain dimension of one half of an inch or less. Of course, the inner side surface 112 of the long thin portion of the article mold cavity 114 and the metal layer 110 have a configuration which corresponds to the configuration of the long thin portion of the article to be cast, that is, the airfoil portion 16 of the vane 10.

As the mold structure 42 is withdrawn from the furnace 68 (FIG. 4) into the vacuum chamber, dendrites grow inwardly and upwardly from the thin skin 110 extending over the side surface 112 (FIG. 5) of the long thin portion of the mold cavity 114. However, the thin skin or layer 110 does not initially extend over the single inlet to the article mold cavity 114. Therefore, molten metal can be fed from a runner 48 into an article mold cavity 114.

The closed lower end portion of each article mold 38 is disposed adjacent to the chill plate 60. The lower end portion of each article mold 38 is lowered from the furnace 68 into the relatively cool vacuum chamber. Therefore, dendrites grow upwardly from the thin skin 110 at a faster rate than they grow inwardly from the thin skin 110.

As an article mold 38 is withdrawn from the furnace 68, molten metal solidifies faster in the lower half 82 of the long thin portion of the article mold than in the upper half 84 of the long thin portion article mold. This is due to the combined effect of: preheating the lower half 82 to a lower temperature than the upper half 84, having the closed lower end of the article mold adjacent to the chill plate 60, and withdrawing the lower end portion of the article mold 38 from the furnace 68 into the relatively cool environment of the vacuum chamber surrounding the furnace 68. Therefore, the molten metal in the article mold cavity 114 solidifies, with an equiaxed grain structure, upwardly from the bottom of the mold cavity at a greater rate than it solidifies inwardly from the upright sides of the article mold cavity.

Figure 6:
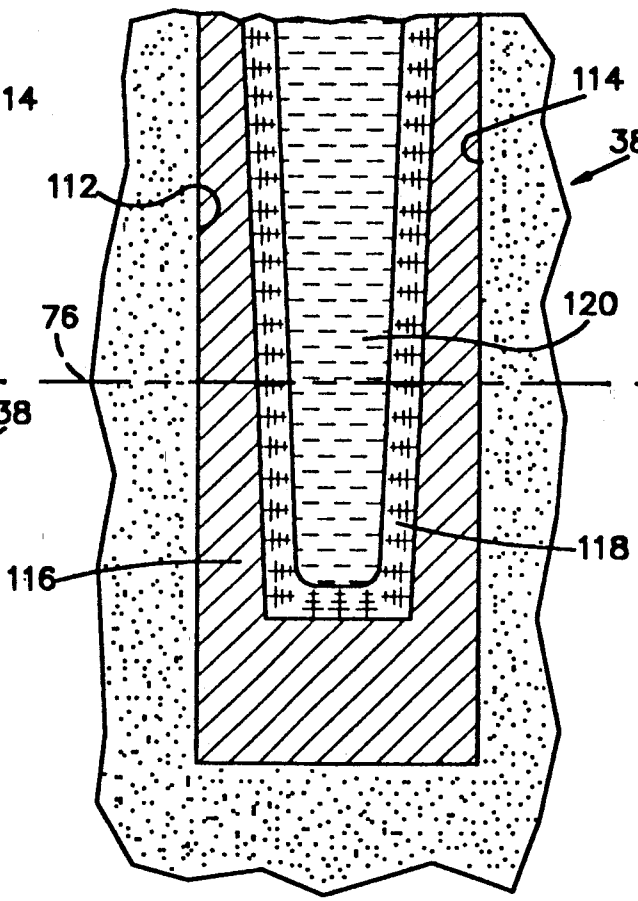
FIG. 6 is a schematic sectional view, generally similar to FIG. 5, illustrating the manner in which the molten metal simultaneously solidifies upwardly from the bottom of the long thin portion of the mold cavity and inwardly from the sides of the mold cavity.

As the molten metal solidifies in the long thin portion of the article mold cavity 114 (FIG. 6), a solid zone 116 is formed at the lower end and along the sides of the long thin portion of the article mold cavity. A mushy zone 118 (FIG. 6) of partially molten, partially solidified metal is located inwardly of the solid zone 116. A liquid zone 120 is located inwardly of the mushy zone 118 and is disposed along the central axis of the long thin portion of the article mold cavity 114. The liquid zone 120 extends upwardly to the opening to a runner or gate 48.

Figure 7:
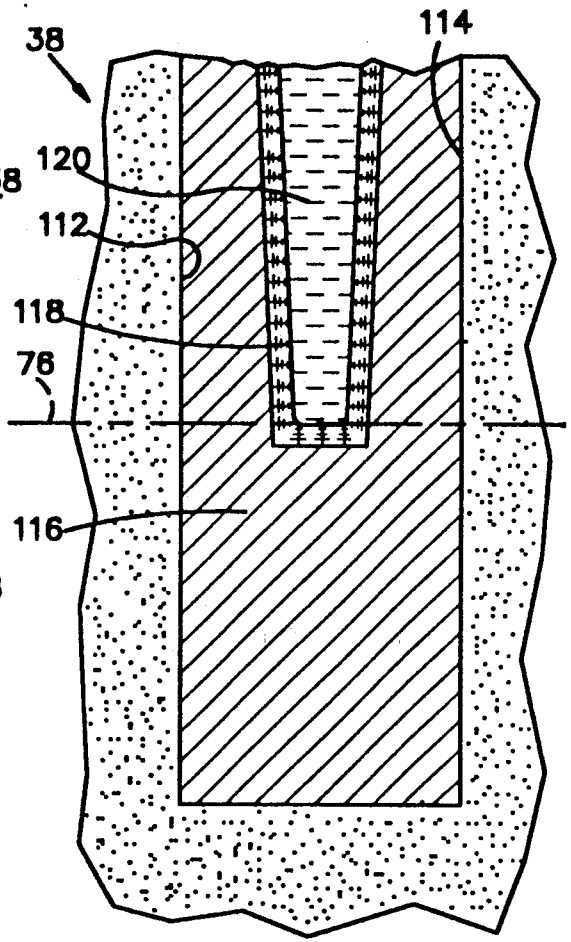
FIG. 7 is a schematic sectional view, generally similar to FIG. 6, illustrating the manner in which the molten metal solidifies in the lower portion of the long thin portion of the article mold cavity before the metal solidifies in the upper portion of the article mold cavity.

Although dendrites will extend from the thickening layer of solidified metal on the upright sides of the long thin portion of the article mold cavity 114 into the mushy zone 118, molten metal can be fed from a runner 48 into the mushy zone to compensate for shrinkage as the molten metal in the mold cavity 114 solidifies. As solidification continues, the size of the mushy zone 118 decreases (FIG. 7) and the amount of solidified molten metal in the lower half of the long thin portion of the article mold cavity 114 increases. Due the effect of the relatively cold chill plate 60, the relatively hot molten metal in the pour cup 46 and runner 48 and the temperature gradient established during preheating of the mold, the shrinking mushy zone 118 moves upwardly along the vertical longitudinal central axis of the long thin portion of the article mold cavity 114.

As the article mold 38 continues to be withdrawn from the furnace 68, the mushy zone 118 will move upwardly at a greater rate than it moves inwardly from the upright sides of the long thin portion of the article mold cavity 114. This enables the molten metal to solidify in the article mold cavity without the formation of voids or other defects. When solidification of the molten metal in the lower half of the long thin portion of the article mold cavity has been completed, the solidification of the molten metal in the upper half of the long thin portion of the article mold cavity will not have been completed. However, when solidification of the molten metal in the lower half of the long thin portion of the article mold cavity has been completed, the majority of the molten metal in the upper half of the long thin portion of the article mold cavity will have solidified. It is estimated that when solidification of the molten metal in the lower half of the long thin portion of the article mold cavity is completed, approximately seventy to eighty five percent of the molten metal in the upper half of the long thin portion of the article mold cavity will have solidified.

Solidification progresses from the lower end of the long thin portion of the article mold cavity 114 to the upper end of this portion of the mold cavity. The feeding of molten metal to compensate for shrinkage occurs along the central axis of the article as the metal solidifies. This technique controls solidification such that it keeps open a central channel 120 inside the solidified metal 116 through which molten metal can feed from top runners 48 to compensate for solidification contraction occurring in remote lower sections.

This technique also actively promotes the availability of transverse secondary interdendritic channels for required lateral feeding of solidifying sections. Transverse interdendritic feeding depends primarily on the length of the interdendritic channels, which are generally determined by the dimensions of the mushy zone 118. Since the width of the mushy zone 118 is inversely related to the prevailing temperature gradients, the positive temperature gradients continually reduce the width of the mushy zone in the solidifying sections and thereby promote effective interdendritic lateral feeding.

As soon as withdrawal of the article mold from the furnace 68 is commenced, it is preferred to have the flow of electrical energy to the furnace coils 90, 92 and 94 (FIG. 4) interrupted. However, the flow of current to the lower coil 94 may only be reduced as the mold 42 moves out of the furnace 68. The amount of electrical energy conducted to the coil 92 may be reduced to a lesser extent. The amount of electrical energy conducted to the coil 90 may be maintained greater than the amount of electrical energy conducted to the coil 92. Regardless of how the coils 90, 92 and 94 are energized, the metal in the pour cup 46 and runners 48 is maintained at least partially molten as the metal in the article molds 38 solidifies.

After the mold structure 42 has been completely withdrawn from the furnace 68, the mold structure and the metal therein is cooled and the ceramic material of the mold removed from the solidified metal. The metal which solidified in the article molds 38 will have an equiaxed grain structure and an overall configuration which corresponds to the configuration of the vane 10. Since there are no gates to supply molten metal to the article mold cavity 114 at locations along the longitudinal central axis of the article mold cavity, the long thin airfoil 16 of the cast vane 10 will be free of gating material. Of course, long thin metal articles other than the vane 10 could be cast with an equiaxed grain structure by using the foregoing method.

Casting a Nickel Chrome Superalloy Vane

The vane 10 of FIGS. 1 and 2 is advantageously formed of a nickel chrome superalloy, such as IN-713C or Rene 77 having a solidus temperature of more than 2,250° F. The article molds 38 are preheated so that the lower half 82 of the long thin portion of each article mold 38 has an average temperature of less than 2,250° F. The upper half 84 of the long thin portion of each article mold 38 is heated to an average temperature of more than 2,000° F. and less than 2,500° F. The molten nickel chrome superalloy is heated to a temperature above 2,400° F. before being poured.

In one specific instance, the vane 10 was formed of Rene 77 having a liquidus temperature of 2,450° F. and a solidus temperature of 2,310° F. The mold structure 42 was preheated so that the closed lower ends of the article molds 38 were at a temperature of approximately 1,850° F. and the upper ends of the article molds were at a temperature of approximately 2,250° F.

The molten Rene 77 was poured at a temperature of 2,650° F. The mold face coat contained 10% by weight of cobalt aluminate inoculant to promote nucleation. When the mold had been heated to have a temperature gradient which ranged from 1,850° F. at the lower ends of the long thin portions of the article molds 38 to 2,250° F. at the upper ends of the long thin portions of the article molds, the molten metal was poured into the pour cup 46.

The molten metal ran through the runners 48 into the article mold cavities 38. As the article molds 38 were filled with molten metal, it is believed that nucleation occurred at various locations along approximately 95% of the longitudinal extent of the long thin portion of the article mold cavity. As soon as the article mold cavities 38 were filled with molten metal, the chill plate 60 was lowered to begin withdrawal of the mold structure 42 from the furnace 68 at a rate of 60 inches per hour. As the mold structure 42 started to be withdrawn from the furnace 68, the electrical energy supplied to the coils 90, 92 and 94 was interrupted.

The vane 10 was cast without any gating along the longitudinal extent of the article mold cavity. The vane 10 had an equiaxed grain structure, similar to the grain structure shown in FIG. 3, and was free of defects. This specific vane had a grain size which was coarser than, but close to, an ASTM grain standard grain size No. 1. None of the surface grains had a maximum dimension of more than one fourth of an inch.

Metal Article—Second Embodiment

In the embodiment of the metal article 10 illustrated in FIGS. 1 and 2, the lower portion 14 of the article 10 is relatively small and solidifies without forming defects in the adjacent long thin portion of the article. However, through experience, it has been learned that when the lower portion 14 is enlarged so as to have a relatively thick or heavy projection and is cast in the manner previously described, the article 10 solidifies with defects adjacent to and/or at the interconnection between the long thin portion 16 and lower portion.

Figure 8:
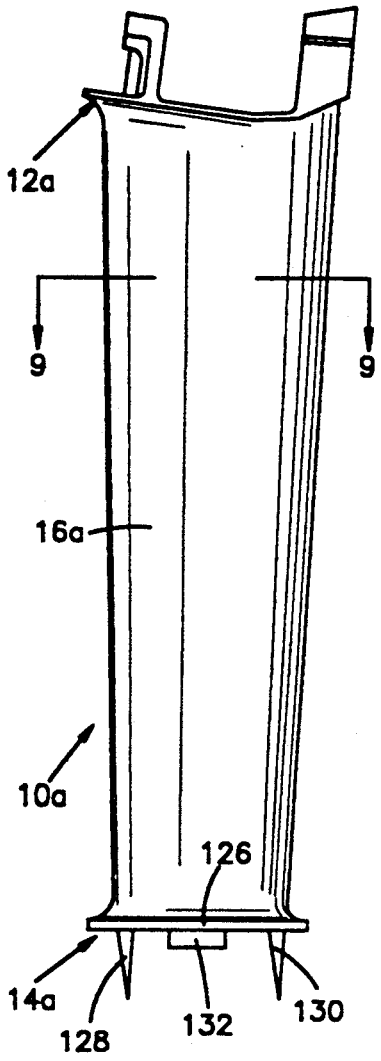
FIG. 8 is an elevational view, generally similar to FIG. 1, of another metal article having a long thin portion.
Figure 9:
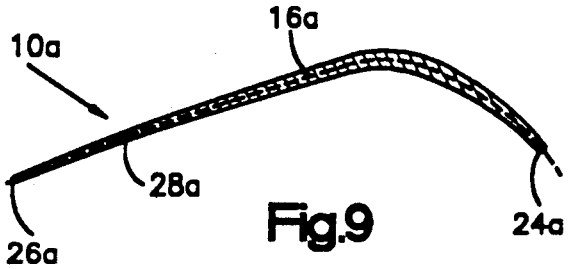
FIG. 9 is a sectional view, taken generally along the line 9—9 of FIG. 8, further illustrating the configuration of the long thin portion of the metal article.
Figure 10:
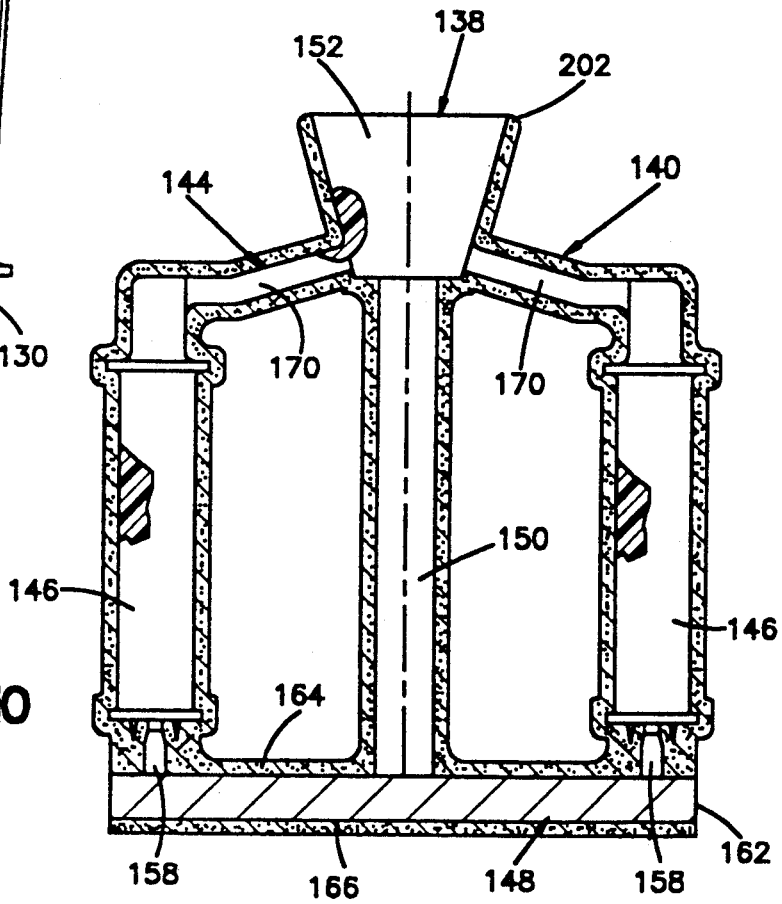
FIG. 10 is a schematicized sectional view of a pattern with a layer of ceramic mold material around the pattern.

In the embodiment of the cast article illustrated in FIGS. 8 and 9, a long thin portion of the article is connected with an enlarged lower portion which is relatively heavy or massive. The article of FIGS. 8 and 9 and the method by which it is cast are generally similar to the article of FIGS. 1 and 2 and the method by which it is cast. Therefore, numerals similar to those used in conjunction with FIGS. 1–7 will be used in conjunction with FIGS. 8–14, the suffix letter "a" being added to the numerals in FIGS. 8–14 to avoid confusion.

The article 10*a* of FIGS. 8 and 9 has a long thin portion and an enlarged end portion. Although the present invention could be utilized to cast many different articles, the article 10*a* is a turbine engine component, specifically, a vane formed of a nickel chrome superalloy having an equiaxed grain structure. The vane or metal article 10*a* has an upper shroud portion 12*a* and an enlarged lower shroud portion 14*a*. A long thin airfoil portion 16*a* extends between and is cast as one piece with the upper and lower shroud portions.

With the exception of the lower shroud portion 14*a*, the vane 10*a* has approximately the same dimensions as the airfoil 10 of FIGS. 1 and 2. Thus, the vane 10*a* has an airfoil portion 16*a* with a length of approximately 7 inches. The airfoil portion 16*a* of the vane 10*a* has a width of approximately 2.5 inches. The distance between the leading edge portion 24*a* (FIG. 9) of the vane 10*a* and a trailing edge portion 26*a* of the vane, as measured along a central axis 28*a*, is approximately 2.5 inches. Since the airfoil portion 16*a* of the vane 10*a* has a slight longitudinal taper, the distance between the leading and trailing edge portions 24*a* and 26*a* varies along the length of the vane. The airfoil portion 16*a* of the vane has a maximum thickness of approximately 0.080 inches. The airfoil portion 16*a* of the vane 10*a* gets thinner toward the leading and trailing edge portions 24*a* and 26*a*.

The airfoil portion 16*a* of the vane 10*a* is a long thin article. Thus, the airfoil portion 16*a* of the vane 10*a* has a length (FIG. 8) of more than four inches. The length of the airfoil portion 16*a* of the vane 10*a* is also at least 20 times the thickness of the airfoil portion. Therefore, the airfoil portion 16*a* of the vane 10*a* meets the requirements for what is and has been referred to herein as a long thin article.

The lower shroud portion 14*a* of the vane 10*a* has a generally rectangular platform 126. The platform projects transversely outwardly from the airfoil portion 16*a*. A pair of thin outer rails or projections 128 and 130 extend downwardly from the platform 126. A thick central rail 132 is disposed between the thin outer rails 128 and 130.

In the embodiment of the metal article 10*a* illustrated in FIGS. 8 and 9, the two outer rails 128 and 130 each have a length of approximately 1.3 inches. The thin outer rails have a triangular cross sectional configuration with a height, as measured from the platform 126 downwardly to the peak, of 0.2 inches and a base, as measured along the platform 126, of 0.05 inches. The central rail 132 extends parallel to the outer rails 128 and 130 has a length of approximately 1.3 inches, a height, as measured downwardly from the platform 126, of approximately 0.1 inches and a width, as measured along the platform 126, of approximately 0.2 inches. Thus, the mass of the central rail 132 is approximately four times the mass of either one of the outer rails 128 and 130. It should be noted that the outer rails 128 and 130 have a relatively large surface area per unit of mass.

It should be understood that the foregoing specific dimensions for the particular metal article or vane 10*a* illustrated in FIGS. 8 and 9 have been set forth herein for purposes of clarity of description and not for purposes of limitation of the invention. Thus, it is contemplated that the airfoil portion 16*a* and/or enlarged shroud portion 14*a* could be constructed with substantially different dimensions if desired. In addition, it is contemplated that the airfoil portion 16*a* and/or shroud portion 14*a* could have a substantially different configuration from the illustrated configuration. For example, the shroud portion 14*a* could be constructed with a pair of relatively heavy outer rails in place of the thin outer rails 128 and 130 and the heavy central rail 132 could be omitted. Thus, the specific configuration and size of the vane 10*a* should be considered as being merely illustrative.

By experimentation, it has been determined that when the metal article or vane 10*a* is cast using the method described in conjunction with the embodiment of the invention illustrated in FIGS. 1–7 herein, defects occur in the long thin airfoil portion 16*a* and/or the platform 126 at a location adjacent to the interconnection between the airfoil portion and shroud portion 14*a*. It is believed that the relatively heavy mass of the central rail 132 alters the thermal gradiants in a manner which causes the metal to solidify in the mold with defects.

By experimentation, it has also been determined that the use of a chill in association with relatively heavy or massive shroud rails, such as the central rail 132, eliminates the defects when the vane 10*a* is cast by using the method previously described in conjunction with FIGS. 1–7 herein. Thus, a chill is exposed to the molten metal which enters the portion of the mold in which the relatively heavy central rail 132 is formed. This causes the molten metal in the central rail forming portion to initially solidify at a greater rate than the remainder of the vane 10*a*.

It is believed that this relatively high initial rate of solidification of molten metal in the rail forming portion of the mold results in a minimization of the effect of the central rail forming portion on the thermal gradiants. Thus, it is believed that the chill results in the platform 126 and metal in the lowermost part of the long thin airfoil portion 16a solidifying in much the same manner as if the relatively thick central rail 132 had been eliminated. It is believed that the mass of the relatively thin outer rails 128 and 130 is insufficient to effect the manner in which the molten metal solidifies in the platform 126 and lowermost part of the long thin airfoil portion 16a.

Regardless of the reasons, it has been determined that when a chill is used for the molten metal in the relatively thick central rail 132, the vane or metal article 10a solidifies without any defects. The solidification of the molten metal in the portion of the article mold cavity which forms the long thin airfoil portion 16a occurs in the same manner as illustrated and previously described in conjunction with FIGS. 5-7 herein when a chill is used in association with the heavy central rail 132. It is not necessary to use chills with the light outer rails 128 and 130.

If the shroud portion 14a had a substantially different configuration, a different chill arrangement would be used. For example, if the shroud portion 14a of the vane 10a had a pair of relatively heavy outer rails and did not have a central rail, a chill would be used for each of the relatively heavy outer rails. Thus, a vane having the same general construction as illustrated in FIG. 8 with the exception that there were two massive outer rails in place of the thin rails 128 and 130 and no central rail, corresponding to the rail 132, was cast using a pair of chills, that is one chill for each rail. The resulting vane was free of defects.

It should be understood that the present invention can be used to cast long thin articles other than the vane 10a. In fact, certain features of the invention can be used in the casting of articles which do not have portions with a long thin configuration. However, it is believed that the features of the present invention are advantageously combined to enable long thin articles to be cast without gating at locations between opposite ends of the articles.

Mold Structure

In accordance with known practices, a wax pattern 138 (FIG. 10) is used to form an improved mold structure 140. The wax pattern 138 may be formed of either natural or artificial wax. The mold structure pattern 138 includes a gating system pattern 144, a plurality of article patterns 146 which are connected with and supported by a base plate. The article patterns 146 have a configuration which corresponds to the configuration of the vane 10a of FIGS. 8 and 9. A solid ceramic support post 150 extends between a wax pour cup pattern section 152 in the gating system 144 and the base 148.

In addition to the foregoing, a pattern assembly 138 constructed in accordance with the present invention includes wax chill patterns 158 which are disposed at the lower ends of the article patterns 146. The wax chill patterns 158 have a configuration which is the same as the configuration of chills which are to be subsequently used in association with the casting of the metal articles 10a. It should be understood that although only two article patterns 146 have been shown in FIG. 10, a plurality of article patterns are disposed in an annular array about the central axis of the pattern. The upper ends of the article patterns are all connected with the gating system pattern 144. There is a chill pattern 158 connected to the lower end of each of the article patterns 146 and to the upper side surface of the circular base plate 148.

The entire wax pattern 138 is repetitively dipped in a slurry of ceramic mold material and stuccoed to build up a layer of mold material over the pattern. Each time the pattern 138 is dipped, a cylindrical outer side surface 162 on the base plate 148 is wiped to remove the mold material from the side surface of the plate. This results in a separation between circular base 164 of the mold structure 140 and a circular layer 166 of mold material on the bottom of the pattern plate 148.

After the wax pattern 138 has been dipped for a number of times sufficient to build up a layer of ceramic mold material having a desired thickness over the pattern, the layer of ceramic mold material is dried. The pattern base plate 148 is separated from the base 164 of the mold structure 140. The wax pattern material is then melted and removed from the ceramic layer by the use of heat and/or chemical solutions. The ceramic mold material is then fired to give it the requisite strength and complete the process of forming the mold structure.

The foregoing process of making the mold structure 140 is well known. However, it should be noted that the wax pattern 138 and the resulting mold structure 140 does not have any provision for gating passages to side portions of the article patterns 146. The article patterns 146 have the same configuration as the vane 10a of FIG. 8. The long thin portion of the article pattern 146 corresponding to the airfoil 16a is completely free of any passages for conducting metal. The only provision for metal conducting passages are in the wax pattern of the gating system 144. Thus, the gating system pattern 144 includes a plurality of runner patterns 170 which extend radially outwardly from the frustoconical pour cup pattern 152 to the upper ends of the article mold patterns 146.

After the wax pattern 138 has been removed from the mold structure 140 with known techniques, the one piece ceramic mold structure 140 (FIG. 11) is complete with a plurality of article molds 38a disposed in an annular array about a pour cup 46a. The article molds 38a have article mold cavities 114a with the same configuration as the vane 10a. The article mold cavities 114a are divided into a lower half 82a and upper half 84a by an imaginary horizontal plane 76a which extends through centers of the long thin portions of the article molds 38a. The upper end of the article mold cavity 114a is connected in fluid communication with the pour cup 46a by a runner 48a. The lower end of the article mold 38a is connected with the circular base plate 164.

The article mold cavity 114a includes a long thin airfoil forming portion 174 having a configuration corresponding to the configuration of the airfoil 16a (FIGS. 8 and 9). In addition, the article mold cavity 114a (FIG. 11) includes a shroud forming portion 176. The shroud forming portion 176 of the article mold cavity 114a includes a platform forming portion 178 having a configuration corresponding to the configuration of the platform 126 (FIG. 8).

A pair of thin outer rail forming portions or cavities 180 and 182 extend downwardly from the platform forming portion 178. The outer rail forming portions 180 and 182 have configurations corresponding to the configurations of the outer rails 128 and 130 of FIG. 8. A central rail forming portion or cavity 128 (FIG. 11) extends downwardly from the platform forming portion 178 at a location midway between the outer rail forming portions 180 and 182. The central rail forming portion 184 has a configuration corresponding to the configuration of the central rail 132.

A chill receiving pocket 186 is disposed immediately beneath the central rail forming portion 184 and has a vertical central axis which is aligned with a central axis of the long thin airfoil forming portion 174 of the mold. The chill receiving pocket 186 has an upper opening 188 which connects the chill receiving pocket 186 with the central rail forming portion 184.

The opening 188 has a configuration corresponding to the configuration of a desired area of exposure of a central rail portion of the article mold to a chill during casting of the vane 10*a*. In addition, the chill receiving pocket 186 has a lower opening 190 through which a chill can be inserted into the pocket. The specific pocket 186 illustrated in FIG. 11 has a circular lower opening 190 and a smaller, rectangular upper opening 188. The pocket 186 itself has a configuration which corresponds to the configuration of a chill which is to be inserted into the pocket.

The upper opening 188 allows molten metal in the central rail forming portion 184 to engage a chill in the pocket 186. However, if it was desired to prevent engagement of the molten metal with the chill, the upper end of the pocket 186 could be closed.

Figure 11:
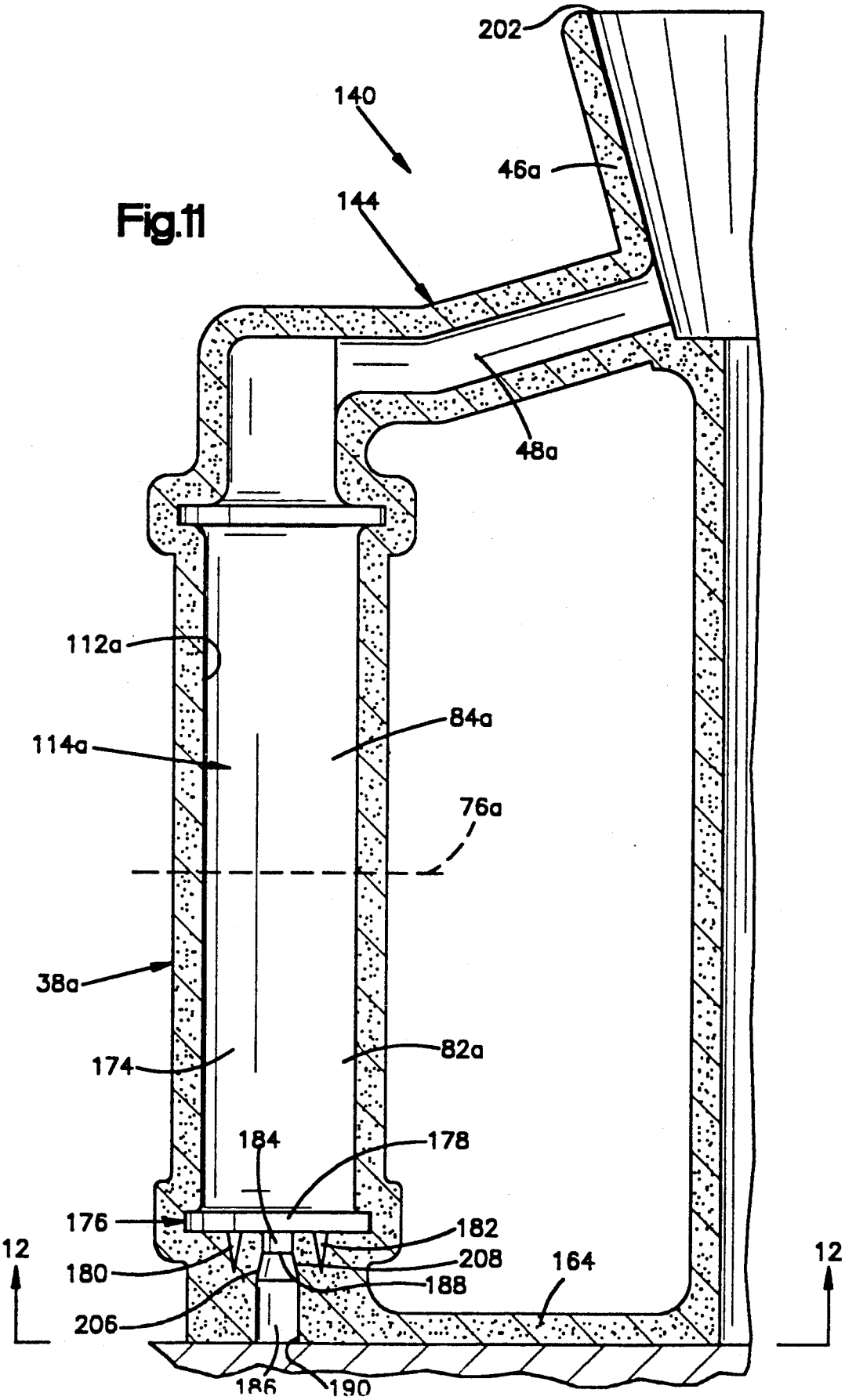
FIG. 11 is an enlarged fragmentary sectional view of a portion of a mold structure formed by the layer of ceramic mold material of FIG. 10 after the pattern has been removed.

Although only a single chill receiving pocket 186 has been illustrated in FIG. 11, it should be understood that there is an annular array of chill receiving pockets 186 (FIG. 12) formed in the circular base plate. In the embodiment of the invention illustrated in FIG. 12, there are twenty chill receiving pockets formed in the base plate. Each of the chill receiving pockets is associated with an article mold 38*a*. The flat circular bottom surface 192 of the base plate 164 (FIG. 12) is formed with a circular array of openings 190 through which chills are inserted into the pockets 186.

Chills having a generally cylindrical configuration are to be inserted into the pockets 186. Therefore, the openings 190 in the base plate 164 are circular. However, if rectangular chills were to be used, a chill receiving pocket 186 would have a rectangular cross sectional configuration and the base plate openings 190 would be similarly configured.

Positioning Chills

When the mold structure 140 is to be used to cast the vanes 10*a* in the article molds 38*a*, chill members 196 (FIG. 13) are inserted into the pockets 186. The chill member 196 includes a cylindrical body portion 198 having a flat end surface 200. The flat end surface 200 is formed with a generally rectangular configuration by grinding away the sides of a cylindrical metal slug.

The specific dimensions of the chill member 198 are a function of dimensions of the article or portion of an article with which the chill member is to be used. A chill for the central rail 132 (FIG. 8) of the vane 10*a* had a rectangular side surface 200 (FIG. 13) with a width corresponding to the width of the central rail 132, that is 0.2 inches. The flat surface 200 had a length which corresponds to the diameter of the body portion 198 of the chill member 196. Although the central rail 132 in the illustrated embodiment of the vane 10 had a length of 1.3 inches, the chill member 196 had a diameter of 0.35 inches. Thus, the length of the upper surface 200 on the chill member 196 is less than ⅓ of the length of the central rail 132 on the vane 10*a*. The upper chill pocket opening 188 is of the same size and configuration as the chill surface 200.

It should be understood that the foregoing dimensions for the chill 196 have been st forth herein merely for purposes of clarity of description and that chill members having a different size and/or configuration could be used if desired. In addition, it should be understood that the relationship between the size of the surface 200 on the chill member to the size of the central rail 132 may be different than the specific relationship set forth herein. For example, the length of the upper chill surface could be equal to the length of the rail 132 if desired.

Figure 12:
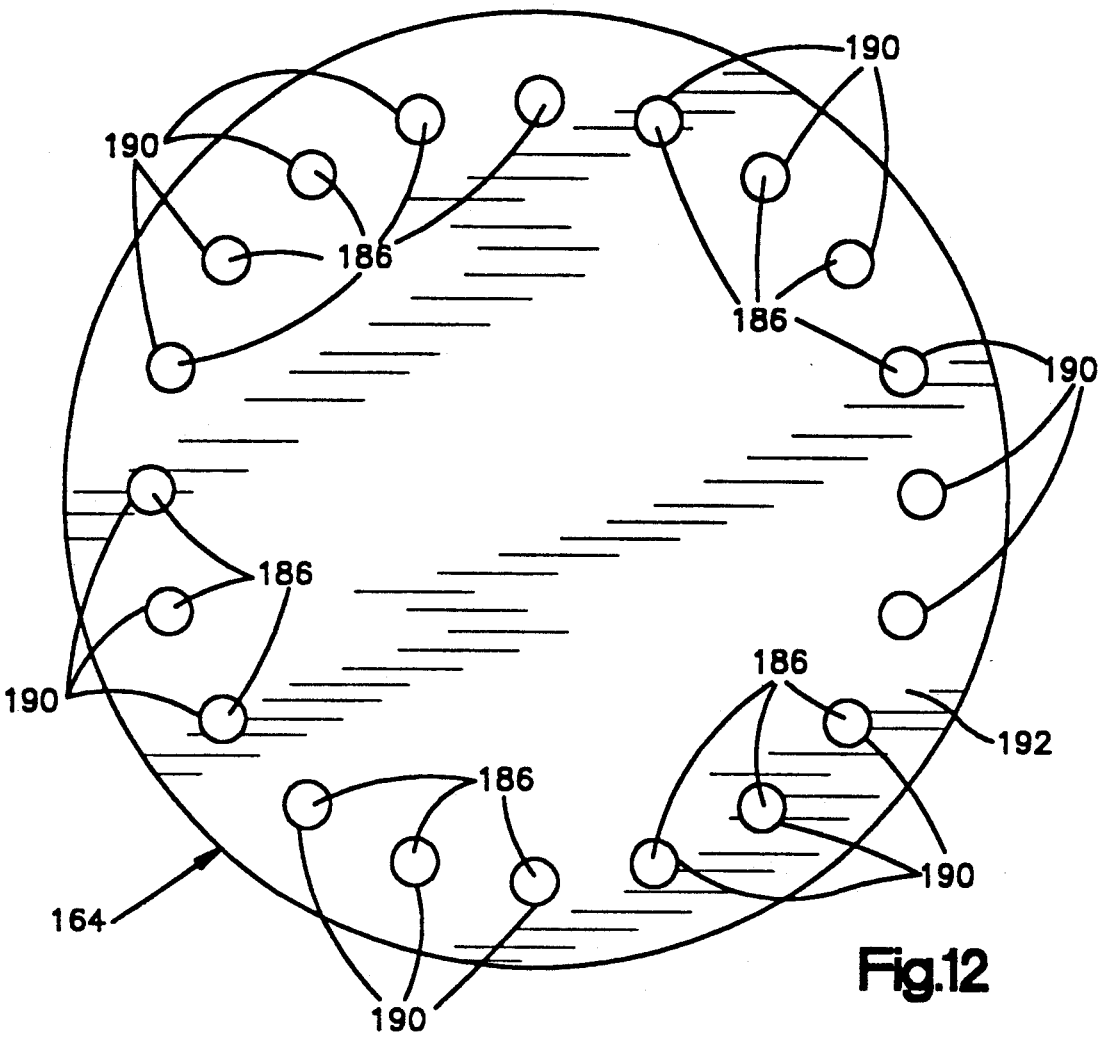
FIG. 12 is a plan view taken generally along the line 12—12 of FIG. 11 on a reduced scale and illustrating a circular array of openings formed in a base plate to provide access to chill receiving pockets.
Figure 13:
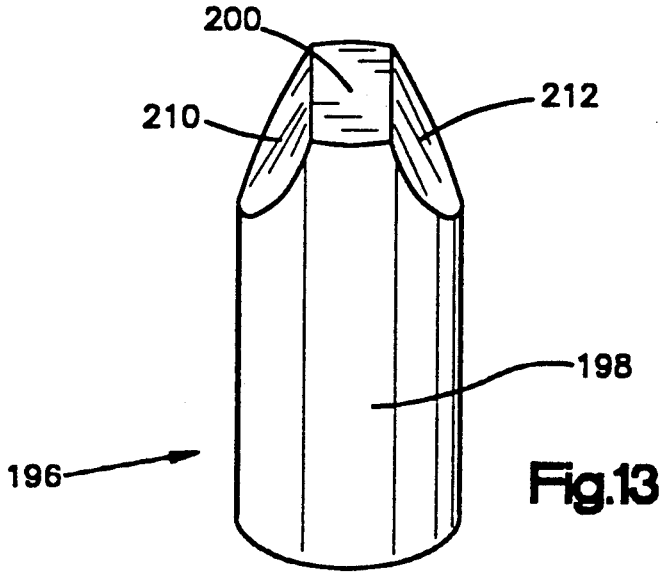
FIG. 13 is an enlarged illustration of a chill which is received in a pocket of the mold of FIG. 12.

When the mold structure 140 is to be used to cast a plurality of vanes 10*a*, the mold structure is first turned up-side-down so that the bottom surface 192 of the base plate 164 faces upwardly to expose the openings 190 to the pockets 186 (FIG. 12). When the mold structure is in the up-side-down orientation, the mold structure may be supported on the pour cup 46*a*. Thus, a circular rim 202 (FIG. 11) on the pour cup 46*a* engages a support surface. The longitudinal central axes of the article mold cavities 114*a* are disposed in a vertical orientation. The gating system 144 is disposed beneath the base plate 164 rather than above the base plate as shown in FIG. 11.

With the mold structure 140 in an up-side-down orientation (FIG. 12), it is a relatively easy matter to insert a chill member 196 into each of the pockets 186. The pockets 186 are sized to grip the outer side surfaces of the chill members 196 to hold them in the pockets. However, a suitable adhesive, such as glue, ceramic mold slurry, or wax, may be used to hold the chill members 196 in the pockets. Thus, a small dab or tack of pattern wax is used to connect the chill members 196 with the base plate 164 of the mold structure 140.

The chill members 196 project out of the pockets 186 for a short distance. Thus, the chill members 196 have an axial extent which is slightly greater than the axial extent of the pockets 186. This results in a cylindrical end portion of each of the chill members projecting out of the pockets 186 for a short distance. In one specific embodiment of the invention, the chill members projected out of the pockets 186 for a distance of approximately 0.1 inches. However, it should be understood that the chill members 196 could be sized to fit completely into the pockets 186 or to project from the pockets for either a greater or lesser distance if desired.

Figure 14:
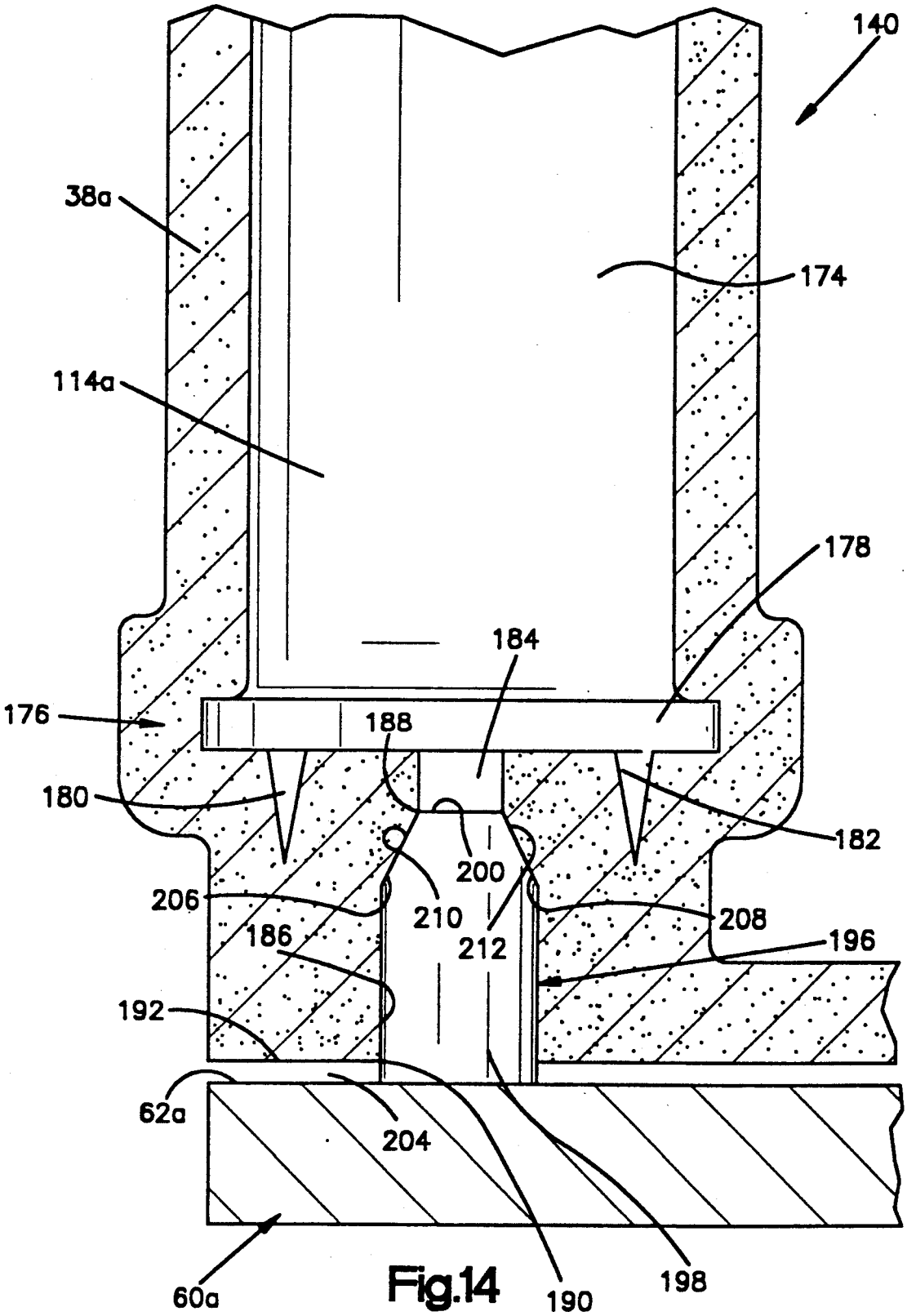
FIG. 14 is a fragmentary schematic illustration depicting the manner in which a mold structure is supported above a chill plate on a chill member.

Once the chill members 196 have been positioned in the pockets 186, the mold is turned back over, that is to a right-side-up orientation in which the gating system 144 is disposed above the base plate 164 (FIG. 11). The mold structure 140, with the chills 196 in the pockets 186 is then placed on a circular water cooled chill plate 60*a* (FIG. 14). When the mold structure 140 is placed on the chill plate 60*a*, the lower ends of the chill members 196 engage the chill plate 60*a* and support the mold structure 140 above the chill plate. As metal solidifies in the article mold 38*a*, heat is transmitted through the chill members 196 to the chill plate 60*a*.

A small gap 204 (FIG. 14) is provided between the circular bottom surface 192 of the base plate 164 of the mold structure 140 and the circular upper side surface 62*a* of the chill plate 60*a*. The size of the gap 204 will depend upon the distance for which the chill members 196 extends from the pockets 186. However, since the chill members 196 all extend for the same distance from the pockets 186, there will be a uniform gap or space 204 between the bottom of the mold structure 140 and the top of the chill plate 60*a*.

Since the mold structure 140 is supported on the chill members 196, tapered inner side surfaces 206 and 208 of the pocket 186 (FIG. 14) are pressed against similarly shaped side surfaces 210 and 212 (FIG. 13) on the chill members 196. This results in the ceramic material of the mold structure 140 being pressed against the metal chill members 196 to form a fluid tight seal at the opening 188 leading to the central rail forming portion 184 of the article mold cavity 114*a* (FIG. 14). In addition, the weight of the mold structure 140 presses the chill members 196 against the water cooled chill plate 60*a* to facilitate the transfer of heat from the chill members to the chill plate. This results in the chill members 196 functioning as upward extensions of the chill plate 60*a*. If desired, the periphery of the base plate 164 of the mold structure 140 can be clamped or otherwise connected to the chill plate 60*a* once the mold structure 140 has been positioned on the chill plate.

Casting of Articles

After the mold structure 140 has been positioned on the chill plate 60*a*, the chill plate is raised into a furnace (not shown) which is evacuated. The furnace then preheats the mold structure 140 in a non-uniform manner. Thus, there is a temperature gradient which increases from a low temperature at the lower ends of the shroud forming portions 176 of the article molds 38*a* to a higher temperature at the upper ends of the airfoil forming portions 174 of the article molds. The lower halves 82*a* (FIG. 11) of the article mold cavities 114*a* in which the long thin airfoil portions 16*a* of the vanes 10*a* are cast, are heated into a first temperature range. The lower ends of the shroud forming portions 176 are at the lowest temperature in the first temperature range. The highest temperature in this first temperature range is close to but is less than the solidus temperature of the metal of the vane 10*a*.

The upper half of the long thin portion of the article mold cavity 114*a* in which the airfoil portion 16*a* of the vane 10*a* is cast is heated into a second temperature range. The second temperature range contains temperatures which are higher than the temperatures in the first range. Since the upper and lower halves 82*a* and 84*a* of the long thin portion of the article mold cavity 114*a* are separated by only an imaginary plane 76*a*, the lowest temperature in the second temperature range into which the upper half 84*a* is heated is the same as the highest temperature of the temperature range into which the lower half 82*a* is heated. The lower end of the shroud forming portion 176 of the preheated article mold 38*a* is at a temperature which is approximately 500° F. less than the temperature of the upper end of the long thin portion of the article molds.

Once the article molds 38*a* have been preheated, molten metal is poured into the pour cup 46*a*. This molten metal is conducted by the gating system 144 (FIG. 11) into the article mold cavity 114*a*. The molten metal flows through the article mold cavity 114*a* into the shroud forming portion 176 of the article mold cavity. Thus, the rail forming portions 180, 182 and 184 of the article mold cavity 114*a* are filled with molten metal. Due to their very thin configuration, the molten metal in the outer rail forming cavities 180 and 182 quickly solidifies. Due to the chill 196, the molten metal in the central rail forming cavity 184 quickly solidifies.

The molten metal in the central rail forming cavity 184 is exposed to the upper side surface 200 of the chill 196 at the opening 188 in the bottom of the rail forming cavity. Since the upper side surface 200 of the chill 196 is relatively cool, the molten metal solidifies at a very high rate without forming a metallurgical bond between the molten metal and the chill 196. Thus, the molten metal in the central rail forming cavity 184 is solidified on the upper side surface 200 of the chill 196 before the metal of the chill is melted. As the molten metal solidifies, heat is transmitted through the chill 196 to the chill plate 60*a*. This results in solidification of the molten metal in the central rail forming portion 184 at a faster rate than in the remainder of the shroud forming portion 176 of the article mold cavity 114*a*.

The relatively high rate of solidification of the metal in the central rail forming portion 184 enables the mass of molten metal in the central rail forming portion to solidify in the same time period that a smaller mass of metal would solidify without the chill 196. Although it is not known for certain, it is believed that this rapid solidification of the molten metal in the central rail forming portion 184 minimizes the effect of the metal in the central rail forming portion on the solidification of the remainder of the shroud portion 176 and the lower end of the long thin airfoil forming portion of the article mold cavity. In any event, it has been determined that, by the use of the chill 196, the formation of defects in the long thin airfoil portion 16*a* of the vane 10*a* adjacent to the platform 126 is eliminated.

Since seventy to one hundred percent of the length of each of the long thin portions of the article molds 38*a* in which the airfoils 16*a* are cast is below the solidus temperature of the molten metal, random nucleation occurs over almost the entire surface of each article mold cavity when the molten metal is poured into the article molds. Therefore, initiation of solidification of the molten metal occurs at locations which are disposed along at least the lower eighty to ninety percent of the long thin portion of each article mold cavity in which the airfoils 16*a* are cast and along the entirety of the shroud forming portion 176.

As soon as the article molds 38*a* are filled with molten metal, withdrawal of the mold structure 140 from the furnace begins. This is accomplished by lowering the chill plate 60*a* at a constant speed. However, the speed of withdrawal of the mold structure 140 could be varied as the mold is withdrawn from the furnace.

As an article mold 38*a* is withdrawn from the furnace, a thin, discontinuous layer or skin of equiaxed metal solidifies over a large majority of an inner side surface 112*a* (FIG. 11) of the long thin portion 174 of the article mold cavity 114*a* and over the entire inner side surface area of the shroud forming portion 176 of the article mold cavity. Although it can only be hypothesized, it is believed that the thin layer extends over all but the upper two to ten percent of the article mold cavity 114*a*. Thus, the thin metal layer extends across the entire surface of the shroud forming portion 176 and upwardly over a large majority of the surface of the long thin airfoil forming portion 174. Of course, the metal layer will have a thick portion over the upper surface 200 of the chill 196. The metal layer has an equiaxed grain structure (FIG. 3) with a maximum grain dimension of one-half of an inch or less.

As the mold structure 140 is withdrawn from the furnace, molten metal solidifies faster in the lower half 82*a* of the long thin portion 174 and the shroud portion 176 of the article mold than in the upper half 84*a* of the long thin portion of the article mold. Therefore, the molten metal in the article mold cavity 114*a* solidifies, with an equiaxed grain structure, upwardly from the bottom of the shroud forming portion 176 at a greater rate than it solidifies inwardly from the upright sides of the shroud portion 176 of the article mold cavity 114*a*.

The molten metal in the shroud forming portion 176 completely solidifies before the lowermost end of the airfoil forming portion 174 completely solidifies. Therefore, molten metal can be supplied to the shroud forming portion 176 from the long thin airfoil forming portion 174 throughout the entire time during which metal is solidifying in the shroud forming portion.

As the molten metal solidifies in the shroud portion 176 and in the long thin portion 174 of the article mold cavity 114*a*, a solid zone is formed at the lower end and along the sides of the shroud forming portion 176 of the article mold cavity. A mushy zone of partially molten, partially solidified metal is located inwardly of the solid zone. A liquid zone is located inwardly of the mushy zone and is disposed along the central axis of the long thin portion 174 of the article mold cavity. The liquid zone extends upwardly to the opening to a runner or gate 48*a*. As solidification continues, the size of the mushy zone decreases and the amount of solidified metal in the lower half of the long thin portion of the article mold cavity 114*a* increases. As the article mold continues to be withdrawn from the furnace, the mushy zone will move upwardly at a greater rate than it moves inwardly from the upright sides of the long thin portion of the article mold cavity 114*a*.

When solidification of the molten metal in the shroud portion 176 and the lower half of the long thin portion 174 of the article mold cavity 114*a* has been completed, the solidification of the molten metal in the upper half of the long thin portion of the article mold cavity will not have been completed. The feeding of molten metal to compensate for shrinkage takes place along the central axis of the long thin portion of the article mold cavity 114*a* as the metal solidifies. The manner in which the molten metal solidifies in the article mold cavity 114*a* is the same as was previously described in conjunction with the article 10 and illustrated in FIGS. 5-7.

Casting One Specific Vane 10*a*

The vane 10*a* of FIGS. 8 and 9 may be formed of a nickel chrome superalloy, such as IN-713C or Rene 77 having a solidus temperature of more than 2,250° F. The article molds 38*a* are preheated so that the lower half 82*a* of the long thin portion 174 of each article mold 38*a* and the shroud portion 176 has an average temperature of less than 2,250° F. The upper half 84*a* of the long thin portion of each article mold 38*a* is heated to an average temperature of more than 2,000° F. and less than 2,500° F. The molten nickel chrome superalloy is heated to a temperature above 2,400° F. before being poured.

In this one specific instance, the vane 10*a* was formed of Rene 77 having a liquidus temperature of 2,450° F. and solidus temperature of 2,310° F. The mold structure 140 was preheated so that the shroud forming portions 176 of the article molds 38*a* were at a temperature of approximately 1,850° F. and the upper ends of the article molds were at a temperature of approximately 2,250° F.

The molten Rene 77 was poured at a temperature of 2,650° F. The mold face coat contained 10% by weight of cobalt aluminate inoculant to promote nucleation. When the mold had been heated to have a temperature gradient which ranged from 1,850° F. at the lower ends of the long thin portions of the article molds 38*a* to 2,250° F. at the upper ends of the long thin portions of the article molds, the molten metal was poured into the pour cup 46*a*.

The molten metal ran through the runners 48*a* into the article mold cavities 114*a*. As the article molds 38*a* were filled with molten metal, it is believed that nucleation occurred at various locations along approximately 95% of the longitudinal extent of the long thin portion of the article mold cavity and along the entire shroud forming portion 176. As soon as the article mold cavities 114*a* were filled with molten metal, the chill plate 60*a* was lowered to begin withdrawal of the mold structure 140 from the furnace at a rate of 60 inches per hour. As the mold structure 140 started to be withdrawn from the furnace, the electrical energy supplied to the coils of the furnace was interrupted.

The vane 10*a* was cast without any gating along the longitudinal extent of the article mold cavity. The vane 10*a* had an equiaxed grain structure, similar to the grain structure shown in FIG. 3, and was free of defects. This specific vane had a grain size which was coarser than, but close to, an ASTM grain standard grain size No. 1. None of the surface grains had a maximum dimension of more than one fourth of an inch. There were no defects at locations adjacent to the interconnection between the long thin airfoil portion 16*a* and shroud portion 14*a*.

Heat Transfer Wall

Figure 4:
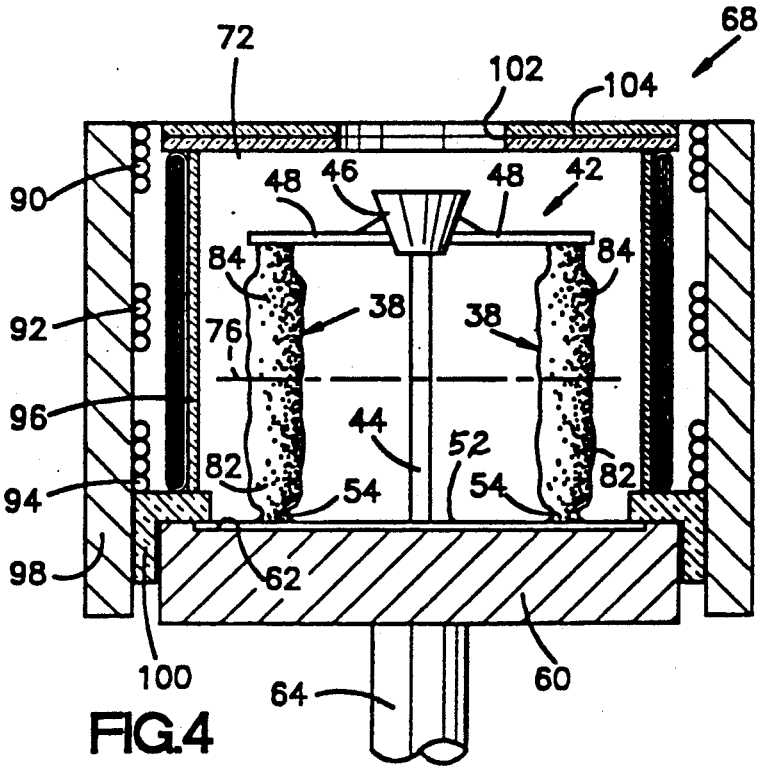
FIG. 4 is a schematic illustration of one way in which a mold structure for casting a plurality of the articles of FIGS. 1 and 2 may be supported on a chill plate in a furnace during preheating and pouring of molten metal into the mold structure.

In the embodiments of the invention illustrated in FIGS. 1-14, heat is transferred directly to and from the mold structure. Thus, when the mold structure 42 of FIG. 4 is in the furnace 68, heat is radiated directly from an inner side surface of the susceptor wall 96 to the mold structure 42 during preheating of the mold structure. After molten metal has been poured into the mold structure and withdrawal of the mold structure from the furnace chamber 72 begins, heat is radiated directly from the article molds 38 to areas outside of the furnace chamber 72. Since areas outside the furnace chamber 72 are relatively cold, compared to the furnace chamber, there is a relatively high rate of heat transfer from the portion of the mold structure 42 which is withdrawn from the furnace chamber.

Figure 15:
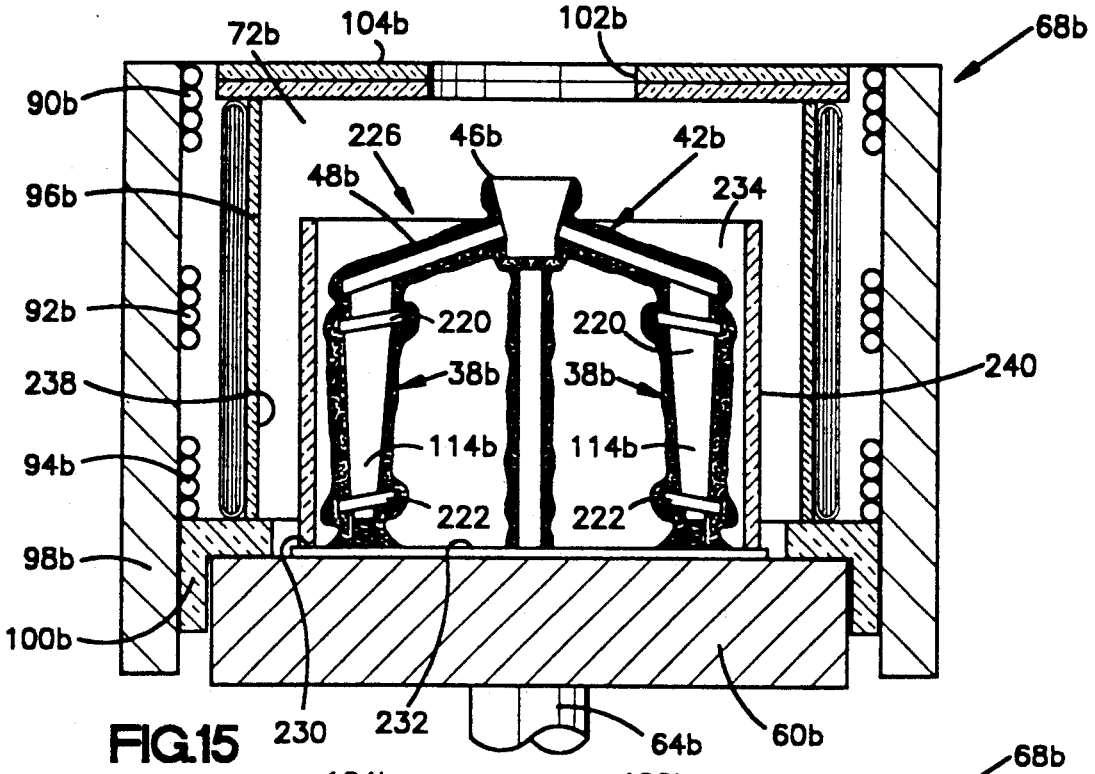
FIG. 15 is a schematic illustration of an embodiment of the invention in which a heat transfer wall is provided around a mold structure.
Figure 16:
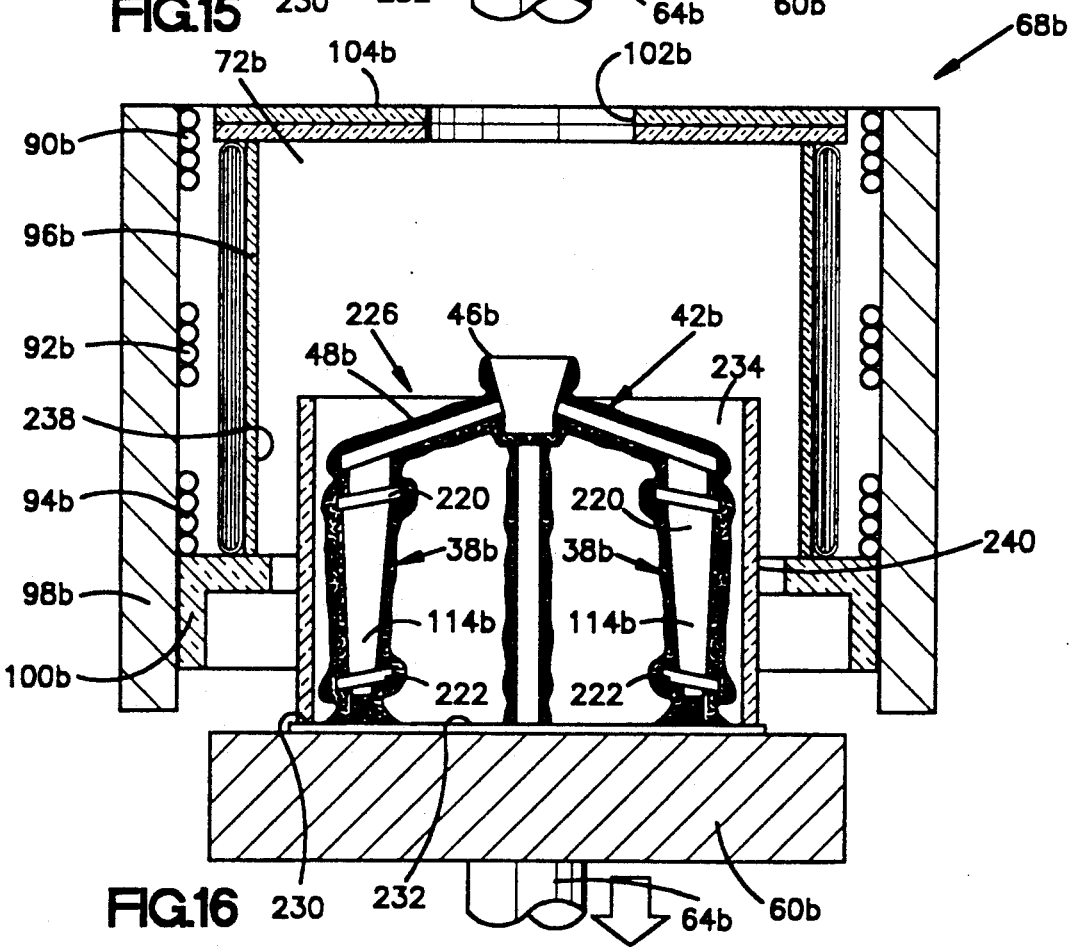
FIG. 16 is a schematic illustration, generally similar to FIG. 15, illustrating the manner in which the heat transfer wall and mold structure are withdrawn from a furnace chamber.

When the article to be cast has a thin portion which extends upwardly from a relatively thick portion, stresses tend to be induced in the metal as it solidifies at the interconnection between the thin portion and the thick portion of the article. In order to promote stress-free solidification of the molten metal at the location where the thick and thin portions of the article are interconnected, a heat transfer wall is provided around the mold structure in the embodiment of the invention illustrated in FIGS. 15 and 16. Since the article, mold structure and furnace used in the embodiment of the invention illustrated in FIGS. 15 and 16 are generally similar to the article, mold structure and furnace illustrated in FIGS. 1-14, similar numerals will be used to designate similar components, the suffix letter "b" being added to the numerals in FIGS. 15 and 16 to avoid confusion.

A mold structure 42*b* is used to cast a metal article having a configuration generally similar to the configuration of the metal article 10*a* of FIG. 8. Specifically, the metal article to be cast in the mold structure 42*b* (FIG. 15) has a long thin portion and a thick portion. The mold structure 42*b* includes a plurality of article molds 38*b* which are disposed in an annular array about a vertical central axis of the mold structure 42*b*.

Each of the article molds 38b includes an article mold cavity 114b with a long thin portion 220 and a thick portion 222. Although the present invention could be utilized to cast many different articles, the articles cast in the mold 42b are vanes for use in a jet engine. Due to the relatively sever operating conditions to which the vanes are exposed, the vanes are formed of a nickel-chrome superalloy. The vanes cast in the article molds 38b have an equiaxed grain structure.

In the long thin portion 220 of each of the article mold cavities 114b, the airfoil portion of a vane is cast. In each of the relatively thick portions 222 of each of the article mold cavities 114b, a shroud portion of a vane is cast. The vane cast in the article mold cavity 114b has approximately the same dimensions as the airfoil 10a shown in FIG. 8.

Thus, the vane cast in the article mold cavity has an airfoil portion with a length of approximately seven inches. The airfoil portion of the vane has a width of approximately 2.5 inches. The distance between the leading edge portion of the vane and a trailing edge portion of the vane, as measured along a central axis, is approximately 2.5 inches. Since the airfoil portion of the vane has a slight longitudinal taper, the distance between the leading and trailing edge portions of the vane varies along the length of the vane. The airfoil portion of the vane has a maximum thickness of approximately 0.080 inches. The airfoil portion of the vane gets thinner toward the leading and trailing edge portions of the vane.

The airfoil portion of a vane to be cast in the article mold cavity 114b is a long thin article. Thus, the airfoil portion of the vane has a length of more than four inches. The length of the airfoil portion of the vane is also at least 20 times the thickness of the airfoil portion. Therefore, the airfoil portion of the vane to be cast in the article mold cavity 114b meets the requirements for what is and has been referred to herein as a long thin article. Although the present invention is advantageously used in conjunction with the casting of long thin articles, the invention may be used in conjunction with the casting of articles which are not long and thin articles.

The thick portion or shroud of the vane is cast in the thick portion 222 of the article mold cavity 114b. The thick portion of the vane includes a generally rectangular platform which projects transversely outwardly from the airfoil portion of the vane. The specific vane to be cast in the article mold cavity 114b does not have a pair of thin outer rails or projections, corresponding to the thin outer rails or projections 128 and 130 of FIG. 8. The relatively thick portion of the vane, that is the shroud, has a width of approximately an inch and a half and a height of approximately five eighths of an inch. It should be understood that the article to be cast in the mold cavity 114b could have a configuration other than the specific configuration described herein and the article could have dimensions different than the dimensions set forth herein.

In order to promote the stress-free solidification of molten metal where a relatively thin portion 220 of the article mold cavity 214b is connected with a relatively thick portion 222 of the article mold cavity, a heat transfer wall 226 is provided around the mold structure 42b. During preheating of the mold structure 42b, the heat transfer wall 226 retards the transfer of heat from the furnace 68b to the mold structure 42b. During withdrawal of the mold structure 42b from the furnace 68b and solidification of molten metal in the mold structure, the heat transfer wall 226 retards the transfer of heat from the portion of the mold structure withdrawn from the furnace to areas outside of the furnace. By retarding the transfer of heat during preheating of the mold structure 42b and during withdrawal of the mold structure 42b from the furnace 68b, the wall 226 enables heat gradients which tend to minimize the formation of stresses at the interconnection between the thick and thin portions of articles to be cast in the mold structure 42b to be established.

Although the heat transfer wall 226 is particularly advantageous when used during the casting of long thin articles having a thick portion, the heat transfer wall could be used during the casting of other articles. For example, the heat transfer wall 226 could be used during the casting of a long thin article which does not have a thick portion. A heat transfer wall similar to the heat transfer wall 226 but shorter, could be used during the casting of a short article having thick and thin portions.

The furnace 68b includes a plurality of helical coils 90b, 92b, and 94b which circumscribe a cylindrical graphite susceptor wall 96b. A cylindrical furnace wall 98b extends around the outside of the coils 90b, 92b, and 94b. An annular ceramic bottom ring 100b is disposed adjacent to the lower end of the furnace wall 98b and is engaged by the lower end of the susceptor wall 96b. A circular opening 102b is provided in an upper end wall 104b to accommodate the pouring of molten metal into the mold structure 42b in the manner previously explained.

When articles are to be cast in the mold structure 42b, the mold structure 42b is placed on a water-cooled copper chill plate 60b. When the mold structure 42b is to be placed on the circular chill plate 60b, the chill plate is first lowered by a support post 64b to a location disposed a substantial distance below the furnace 68b. The one piece ceramic mold structure 42b is then placed on the chill plate 60b.

The cylindrical graphite heat transfer wall 226 is then positioned around the mold structure 42b. A lower end portion 230 of the heat transfer or inner wall 226 engages a flat circular ceramic base 232 of the mold structure. Therefore, the lower end portion 230 of the inner or heat transfer wall 226 is not in direct contact with the relatively cool chill plate 60b.

A cylindrical inner side surface 234 of the heat transfer wall 226 extends around the mold structure 42b. The inner side surface 234 of the heat transfer wall 226 is spaced apart from the molds 38b. When the heat transfer wall 226 has been positioned relative to the mold structure 42b, the vertical central axes of the heat transfer wall and mold structure are coincident with the vertical central axes of the chill plate 60b, support post 64b, and furnace chamber 72b.

Once the mold structure 42b and heat transfer wall 226 have been positioned on the chill plate 60b, a motor (not shown) connected with the support post 64b is operated to raise the chill plate 60b, mold structure 42b and heat transfer wall 226 into the cylindrical furnace chamber 72b (FIG. 15). When the mold structure 42b is disposed in the furnace chamber 72b, the cylindrical heat transfer wall 226 is spaced from both the article molds 38b and the susceptor wall 96b. The cylindrical heat transfer wall 226 extends around the article molds 38b and has a vertical extent which is greater than the vertical extent of the article molds 38b. Therefore, the cylindrical heat transfer wall 226 blocks direct exposure of the article molds 38b to the susceptor wall 96b of the furnace 68b (FIG. 15).

To preheat the mold structure 42b, the furnace coils 90b, 92b and 94b are energized. The coils 90b, 92b and 94b effect heating of the mold structure 42b in such a manner as to establish a vertical temperature gradient in the mold structure. The temperature gradient increases from a low temperature at the lower end of the article molds 38b to a higher temperature at the upper ends of the article molds.

The establishment of the temperature gradient is facilitated by the fact that the mold structure 42b is supported on the water cooled copper chill plate 60b and by energizing the coils 90b, 92b and 94b to different extents. Thus, the amount of electrical energy which is conducted to the coil 90b is greater than the amount of electrical energy conducted to the coil 92b. The amount of electrical energy conducted to the coil 92b is greater than the amount of electrical energy conducted to the coil 94b.

The temperature gradient results in the lower half of the long thin portion of each of the article molds being heated in a first temperature range and the upper half of the of the long thin portion of each of the article molds being heated into a second temperature range which is higher than the first temperature range. The highest temperature in the first temperature range is close to but is less than the solidus temperature of the metal articles to be cast in the mold structure 42b. The second temperature range contains temperatures which are higher than the temperatures in the first temperature range. The highest temperature of the second temperature range into which the upper half of the long thin portions of the article molds 38b are heated is close to the solidus temperature of the metal forming the articles to be cast in the mold structure 42b. The highest temperature to which the upper half of the article molds 38b is heated may be somewhat greater than the solidus temperature of the metal of the article to be cast or somewhat less than the solidus temperature of the article.

The establishment of a relatively uniform temperature gradient from the lower end of the article molds 38b to the upper ends of the article molds is facilitated by provision of the cylindrical heat transfer wall 226. Thus, when the mold structure 42b is to be preheated, the furnace coils 90b, 92b and 94b are electrically energized. The magnetic fields from the energized coils 90b, 92b and 94b induce electrical currents in the graphite susceptor wall 96b. Due to the electrical resistance of the susceptor wall, the induced currents cause the susceptor wall to become hot.

Heat is radiated from a cylindrical inner side surface 238 of the graphite susceptor wall 96b to a cylindrical outer side surface 240 of the heat transfer wall 226. The heat transfer wall 226 is spaced apart from and is coaxial with the susceptor wall 96b. The heat which is radiated from the susceptor wall 96b to the heat transfer wall 226 heats the transfer wall. The heat transfer wall 226 has a relatively high thermal conductivity. It is preferred to form the heat transfer wall of graphite which is easily machined and has a thermal conductivity 64.5 Btu/hr. ft.° F. at 68° F. Of course, the heat transfer wall 226 could be formed of other materials if desired.

Heat is radiated from the cylindrical inner side surface 234 of the heat transfer wall 226 to the article molds 38b. The presence of the heat transfer wall 226 promotes the establishment of a uniform temperature gradient from the lower end portions of the article molds 38b to the upper end portions of the article molds.

During the casting of nickel-chrome superalloys to form vanes having an equiaxed crystallographic structure, the upper end portions of the article molds 38b are heated to a temperature of approximately 2,400° F. while the lower end portions of the article molds are heated to a temperature of approximately 1,800° F. Of course, the vertical temperature gradient which is established along the length of the article molds 38b may be different from these specific temperatures. Thus, it is contemplated that the temperature gradient along the length of the molds 38b may vary between a maximum of 800° to a minimum of 50° F., depending upon the configuration of the articles to be cast in the mold structure 42b and the metal of which they are formed. However, by radiating the heat from the susceptor wall 96b to the heat transfer wall 226, and then radiating heat from the transfer wall 226 to the mold structure 42b, the establishment of a uniform temperature gradient along the length of the article molds 38b is facilitated.

During preheating of the mold structure 42b, the heat transfer wall 226 is heated with a temperature gradient which corresponds to the temperature gradient established in the mold structure 42b. However, the actual temperatures in the heat transfer wall 226 will be slightly greater than the temperatures at the same level in the mold structure 42b. Thus, the lower half of the heat transfer wall 226 is heated into a first temperature range and the upper half of the heat transfer wall is heated into a second temperature range. The highest temperature in the first temperature range is close to but less than the solidus temperature of the metal articles to be cast in the mold structure 42b. The second temperature range contains temperatures which are higher than the temperatures in the first temperature range. The highest temperature of the second temperature range into which the upper half of the heat transfer wall 226 is heated is close to the solidus temperature of the metal forming the articles to be cast in the mold structure 42b.

The time required to preheat the mold structure 42b by radiating heat from the susceptor wall 96b to the heat transfer wall 226 and by radiating heat from the heat transfer wall to the mold structure will be slightly greater than the time required to preheat the mold if the heat transfer wall 226 was omitted. However, the obtaining of a more uniform and controlled temperature gradient in the mold structure 42b warrants the slightly longer preheat time. The time required for preheating the mold structure 42b is reduced by forming the heat transfer wall 226 of a highly conductive material. It is preferred to form the heat transfer wall 226 of graphite since this material has a relatively high heat conductivity and is readily machined. However, beryllium oxide, silicon carbide, alumina, or other materials could be used to form the heat transfer wall 226.

Once the article molds 38b have been preheated in the foregoing manner, molten metal is conducted through the circular opening 102b in the upper end wall 104b of the furnace 68b into a pour cup 46b of the mold structure 42b. At the time of pouring, the molten metal may be superheated by 50° to 400° F. The pouring of molten metal occurs in a vacuum chamber or housing which surrounds the furnace 68b.

Although it is preferred to fill the article mold cavity 114b from only a single runner or gate 48b, a second runner or gate could be connected with the relatively thick lower portion 222 of the article mold 38b if desired. Regardless of how the article molds 38b are filled with molten metal, the long thin portion 220 of the article mold cavity 114b is free of gating along its length. Thus, the article mold 38b has only a single inlet at its upper end.

The molten metal flows from the pour cup 46b through the gate 48b into the upper end of the article mold cavity. The molten metal flows through the long thin portion 220 of the article mold cavity 114b into the relatively thick portion 222 of the article mold cavity. There are no gates or feeders of any type along the sides of the long thin portion 220 of the article mold cavity 114b. However, it is contemplated that a blind gate or riser could be connected with the relatively thick portion 222 of the article mold cavity 114b if desired.

Since seventy to one hundred percent of the length of each of the long thin portions 220 of the article molds 38b are below the solidus temperature of the molten metal, random nucleation occurs over almost the entire surface of each of the article mold cavities 114b when the molten metal is poured into the article molds. Although the exact extent of nucleation on the surfaces of the article mold cavities 114b is not known, it is believed that nucleation and, therefore, initiation of solidification of the molten metal, occurs at locations which are disposed along at least the lower eighty to ninety percent of the long portion of each article mold cavity.

As soon as the article molds 38b are filled with molten metal, withdrawal of the mold structure 42b from the furnace 68b begins. It should be noted that the molten metal has not been shown in the mold structure 42b in FIG. 16 for purposes of clarity of illustration. The rate of withdrawal of the mold structure 42b from the furnace 68b into the vacuum chamber surrounding the furnace is relatively high, that is, at a rate of 60 to 120 inches per hour. However, slower withdrawal speeds have also been used. Withdrawal of the mold structure 42b from the furnace 68b is accomplished by lowering the chill plate 60b and its support post 64b at a constant speed. However, the speed of withdrawal of the mold structure 42b could be varied as the mold structure is withdrawn from the furnace 68b.

As the lower end portions of the article molds 38b and heat transfer wall 226 initially move out of the furnace chamber 72b, heat is radiated from the outer side surface 240 of the lower end portion of the heat transfer wall 226 to areas outside the furnace chamber 72b. At this time, heat is radiated from the relatively thick portions 222 of the article molds 38b to the inner side surface 234 of the heat transfer wall 226.

As the lower portion of the mold structure 42b moves out of the furnace, the rate of heat transfer from the relatively thick portions 222 of the article mold cavities 114b increases at a rate which is less than it would be if the heat transfer wall 226 was omitted In addition, the heat transfer wall 226 retards the transfer of heat from the lower end of the long thin portion 220 of the article mold cavity 114b. Therefore, the rate of cooling of the lower portion of the mold structure 42b is reduced somewhat by the presence of the heat transfer wall 226.

Reducing the rate of heat transfer from the lower portions of the article molds 38b as the mold structure 42b is withdrawn from the furnace chamber 72b enables the molten metal in the relatively thick portion 222 to completely solidify before the molten metal in the lower end of the long thin portion 220 of the article mold cavity 114b solidifies. Due to the reduced rate of heat transfer from both the relatively thick portion 222 of the article mold cavity 114b and from the lower end of the long thin portion 220 of the article mold cavity, the molten metal in the thick and thin portions solidifies with a minimum of stress. This tends to minimize the formation of defects at the interconnection between the thick portion 222 and thin portion 220 of an article cast in the mold cavity 114b.

As the mold structure continues to be withdrawn from the furnace chamber 72 (FIG. 16), heat continues to be radiated from the outer side surface 240 of the wall 226 to areas outside of the furnace chamber 72b and heat continues to be radiated from the article molds 38b to the inner side surface 234 of the wall. Since the portion of the wall 226 remaining inside the furnace chamber 70b is exposed to the relatively hot susceptor wall 96b rather than the relatively cool environment surrounding the furnace 68b, the rate of heat transfer from the upper portion of the wall 226 is less than the rate of heat transfer from the lower portion of the wall. This results in controlled solidification of the molten metal in the article mold cavities 114b with an equiaxed grain structure in the same manner which has been illustrated in FIGS. 5, 6 and 7 in connection with the embodiment of the invention shown in FIGS. 1–7.

After the mold structure 42b has been completely withdrawn from the furnace 68 and the molten metal solidified, the ceramic mold material is removed from the solidified metal. The metal which solidified in the article molds 38b will have an equiaxed grain structure with an overall configuration which corresponds to the desired configuration of a vane. Since there are no gates to supply molten metal to the article mold cavity 114b at locations along the longitudinal central axis of the article mold cavity, the long thin airfoil portion of a cast vane will be free of gating material. Of course, long thin metal articles other than a vane could be cast with an equiaxed grain structure by using the foregoing method.

In the illustrated embodiment of the invention, the heat transfer wall 226 has a vertical extent which is greater than the vertical extent of the article molds 38b. However, the heat transfer wall could have a vertical extent which is less than the vertical extent of the article molds 38b. For example, the heat transfer wall 226 could terminate a short distance above the thick portion 222 of the mold cavity 114b if desired. This would enable the heat transfer wall 226 to control the solidification of molten metal in the thick portion 222 and the interconnection between the thick and thin portions 222 and 220 of the article mold cavity 114b.

Although it is preferred to withdraw the entire mold structure 42b from the furnace chamber 72b by lowering the chill plate 60b, the chill plate could be lowered through only a short distance while the metal solidifies in the article molds 38b. Thus, solidification of the molten metal in the thick portions 222 of the article mold cavity could be promoted by withdrawing only the thick portion 222 of the article mold cavity from the furnace chamber 72b. The molten metal in the remainder of the article mold cavity 114b would be solidified while in the furnace chamber. If this is done, the heat transfer wall 226 could have a relatively short vertical extent.

Heat Transfer Wall—Second Embodiment

Figure 17:
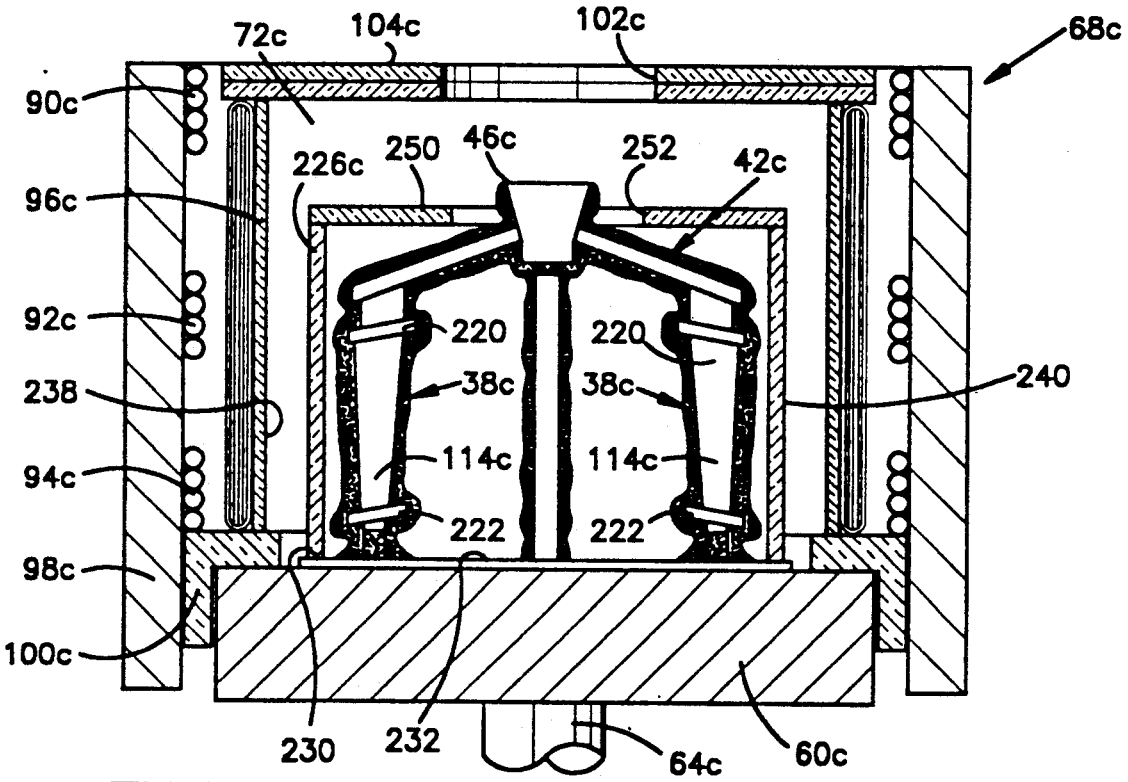
FIG. 17 is a schematic illustration, generally similar to FIG. 15, illustrating a second embodiment of the heat transfer wall.

In the embodiment of the invention illustrated in FIGS. 15 and 16, the heat transfer wall 226 extends upwardly past the upper ends of the article molds 38b to a circular opening through which the gating system, that is the pour cup, extends. The upper end portions of the article molds 38*b* are, to some extent at least, exposed to direct radiation of heat from the susceptor wall 96*b* through the circular opening at the upper end of the heat transfer wall 226. In the embodiment of the invention illustrated in FIG. 17, an upper side wall is connected with the heat transfer wall to at least partially block the upper end of the heat transfer wall. Since the embodiment of the invention illustrated in FIG. 17 is generally similar to the embodiment of the invention illustrated in FIGS. 15 and 16, similar numerals will be utilized for similar components, the suffix letter "c" being associated with the components of FIG. 17 to avoid confusion.

A furnace 68*c* is provided with a plurality of coils 90*c*, 92*c* and 94*c* which are energized to heat a cylindrical susceptor wall 96*c*. A mold structure 42*c* is supported on a circular water-cooled copper chill plate 60*c* in a cylindrical furnace chamber 72*c*.

The mold structure 42*c* includes a plurality of article molds 38*c* disposed in an annular array. A cylindrical graphite heat transfer wall 226*c* extends around the mold structure 42*c* and is spaced apart from article molds 38*c* and the susceptor wall 96*c*.

In accordance with a feature of this embodiment of the invention, a flat circular end wall 250 is disposed on the upper end of the heat transfer wall 226*c*. The flat circular end wall 250 has a circular central opening 252 through which the pour cup 46*c* of the mold structure 42*c* extends. The upper side wall 250 is formed of graphite and blocks the direct radiation of heat from the susceptor wall 96*c* to the upper end portion of the mold structure 42*c*. In one specific embodiment of the invention, the upper side wall 250 was formed of "Graphfoil" (trademark).

Conclusion

In view of the foregoing description, it is apparent that the present invention provides a new and improved method and apparatus for use in casting a metal article which is long and thin and/or has a thin portion connected with a thick portion. The formation of a stress-free interconnection between the thick 222 and thin portions 220 of the article is promoted by the use of an inner or heat transfer wall 226 which extends around the article molds 38*b*. During preheating of the mold structure 42*b*, heat is radiated from an inner side surface 238 of a furnace chamber 72*b* to an outer side surface 240 of the inner or heat transfer wall 226 which extends around the article molds 38*b*. Heat is radiated from an inner side surface 234 of the heat transfer wall 226 to the article molds 38*b*. During solidification of the molten metal in the mold structure 42*b*, heat is radiated from the article molds 38*b* to the inner side surface 234 of the heat transfer wall 226 and is radiated outwardly from the outer side surface 240 of the wall. The use of the heat transfer wall 226 is particularly advantageous when the mold structure 242*b* is withdrawn from the furnace chamber 68*b* during solidification of the molten metal. This is because the wall 226 retards the transfer of heat from the article molds 38*b* and promotes the maintenance of relatively uniform temperature gradients along the length of the article molds.

Having described specific preferred embodiments of the invention, the following is claimed:

1. An apparatus for use in casting a metal article having interconnected thick and thin portions, said apparatus comprising furnace means for transmitting heat to a mold structure in which the metal article is to be cast, movable chill plate means for receiving heat during casting and for supporting the mold structure in said furnace means while molten metal is conducted into the mold structure, means for moving said chill plate means and mold structure relative to said furnace means between a raised position in which the mold structure is disposed in said furnace means and a lowered position in which the mold structure is at least partially withdrawn from said furnace means, and wall means for promoting stress free solidification of the molten metal in the portion of the metal article where the thick and thin portions are interconnected, said wall means being movable with said chill plate means and being spaced apart from and extending around the outside of at least a portion of the mold structure with open space between said wall means and the mold structure to retard the transfer of heat from the portion of the mold structure where the molten metal is solidified to form the interconnection between the thick and thin portions of the metal article during movement of the mold structure from the raised position to the lowered position, said wall means having an inner side surface area from which heat is radiated to the mold structure through the open space between said wall means and the mold structure when the mold structure is in the raised position and to which heat is radiated from the mold structure through the open space between said wall means and the mold structure during movement of said chill plate means and mold structure from the raised position to the lowered position.

2. An apparatus as set forth in claim 1 wherein said wall is formed of a material having a greater rate of heat conductivity than the material of the ceramic mold structure.

3. An apparatus as set forth in claim 1 wherein said furnace means includes a susceptor wall and induction coil means for inducing a flow of electrical current in said susceptor wall to heat said susceptor wall, said wall means being disposed between the mold structure and said susceptor wall when the mold structure is in the raised position to enable said wall means to be heated by heat radiated from said susceptor wall.

4. An apparatus as set forth in claim 1 wherein the mold structure includes an article forming portion in which the metal article is cast and a gating portion through which molten metal is conducted into the article forming portion, said wall means having a lower end portion which is disposed adjacent to a lower end portion of the article forming portion of the mold structure and an upper end portion which is disposed adjacent to an upper end portion of the article forming portion of the mold structure, said wall means being formed of a material having a greater rate of heat conductivity than the material of the ceramic mold structure.

5. An apparatus as set forth in claim 1 wherein said wall means includes a cylindrical side wall portion which extends around the mold structure and an end wall portion which extends radially inwardly from the side wall portion of said wall means.

6. An apparatus as set forth in claim 5 wherein the mold structure includes an article forming portion in which the metal article is cast and a gating portion through which molten metal is conducted into the article forming portion, said end wall portion of said wall means extending across an upper end of the article forming portion of the mold structure, said end wall including surface means for defining an opening through which a portion of the mold structure extends.

7. An apparatus as set forth in claim 1 wherein said furnace means includes a generally cylindrical susceptor wall which is at least partially formed of graphite and coil means extending around the outside of said susceptor wall, said coil means being energizeable to induce a flow of electrical current in said susceptor wall to heat said susceptor wall, said wall means including a generally cylindrical graphite inner wall having an outer side surface to which heat is radiated from said susceptor wall and an inner side surface from which heat is radiated to the mold structure.

8. An apparatus as set forth in claim 1 wherein said wall means is spaced apart from said furnace means and is supported by said chill plate means.

9. An apparatus as set forth in claim 1 wherein the mold structure includes an upwardly extending article forming portion and an outwardly extending base plate portion disposed on said chill plate means, said wall means having a lower end portion which engages the base plate portion of the mold structure.

10. An apparatus for use in casting a metal article, said apparatus comprising a susceptor wall which is at least partially formed of graphite and which at least partially defines a furnace chamber, electrical conductor means extending around the outside of said susceptor wall for conducting an electrical current to effect a heating of said susceptor wall by inducing a flow of electrical current in said susceptor wall, movable chill plate means for supporting a mold structure in the furnace chamber, said chill plate means being movable relative to said susceptor wall to at least partially withdraw the mold structure from the furnace chamber, an inner wall at least partially formed of graphite and extending around the outside of at least a portion of the mold structure with open space between said inner wall and mold structure, said inner wall having an outer side surface area which is spaced from said susceptor wall and to which heat is radiated from said susceptor wall when said inner wall and mold structure are in the furnace chamber, said inner wall having an inner side surface area from which heat is radiated through the open space to the mold structure when said inner wall and mold structure are in the furnace chamber, said inner wall being at least partially movable from the furnace chamber during withdrawal of the mold structure from the furnace chamber, said inner side surface area of said inner wall being effective to receive heat radiated from the mold structure through the open space when at least a portion of the mold structure is outside the furnace chamber, said outer side surface area of said inner wall being effective to radiate heat outwardly to areas outside of the furnace chamber when at least a portion of the mold structure is outside the furnace chamber.

11. An apparatus as set forth in claim 10 wherein the metal article has interconnected thick and thin portions, said inner wall extending around the outside of the portion of the mold structure in which molten metal is solidified to form an interconnection between the thick and thin portions of the metal article.

12. An apparatus as set forth in claim 10 wherein said susceptor wall has a generally cylindrical configuration, said inner wall having a generally cylindrical configuration and being disposed in a coaxial relationship with and being spaced apart form said susceptor wall when the mold structure is in the furnace chamber.

13. An apparatus as set forth in claim 10 further including an end wall disposed at an upper end portion of said inner wall and extending over at least a portion of the mold structure.

14. A method of casting a metal article having interconnected thick and thin portions, said method comprising the steps of providing a mold structure having an article mold cavity with a configuration corresponding to the configuration of the metal article, preheating the mold structure in a furnace chamber, conducting molten metal into the preheated mold structure while the mold structure is in the furnace chamber, at least partially withdrawing the mold structure and a wall extending around the mold structure from the furnace chamber with open space between the wall and the mold structure, solidifying the molten metal in the article mold cavity with an equiaxed grain structure, radiating heat through the open space to the wall from the portion of the mold structure in which molten metal is solidified to form the interconnection between the thick and thin portions of the article while the wall and mold structure are being withdrawn from the furnace chamber, and radiating heat from the wall to areas outside of the furnace chamber while the wall and mold structure are being withdrawn from the furnace chamber.

15. A method as set forth in claim 14 wherein said step of preheating the mold structure includes radiating heat from a wall of the furnace to the wall extending around the mold structure and radiating heat from the wall extending around the mold structure and to the mold structure.

16. A method as set forth in claim 14 wherein the wall extending around the mold structure extends at least along the vertical extent of the portion of the mold structure in which the article mold cavity is disposed.

17. A method as set forth in claim 14 wherein said step of preheating the mold structure is performed with the wall extending around the mold structure.

18. A method as set forth in claim 14 wherein said step of withdrawing the mold structure and the wall extending around the mold structure from the furnace chamber includes completely withdrawing the mold structure and wall from the furnace.

19. A method as set forth in claim 14 further including the steps of supporting the wall and mold structure with a chill plate during performance of said step of withdrawing the mold structure and wall from the furnace chamber and conducting heat from the molten metal in the mold structure to the chill plate during performance of said step of withdrawing the mold structure from the furnace chamber.

20. A method as set forth in claim 14 wherein said step of preheating the mold structure includes radiating heat from an inner side surface of the furnace chamber to an outer side surface of the wall extending around the mold structure and radiating heat from an inner side surface of the wall extending around the mold structure to the mold structure while maintaining the outer side surface of the wall extending around the mold structure spaced from the inner side surface of the furnace chamber.

21. A method as set forth in claim 20 wherein said step of preheating the mold structure includes the step of inducing an electrical current flow in a furnace wall upon which the inner side surface of the furnace chamber is disposed.

22. A method as set forth in claim 20 wherein said step of radiating heat from an inner side surface of the chamber to an outer side surface of the wall extending around the mold structure includes the steps of heating a lower half of the wall extending around the mold structure into a first temperature range, the highest temperature of the first temperature rang being close to the solidus temperature of the metal article, and heating an upper half of the wall extending around the mold structure into a second temperature range containing temperatures which are greater than the first temperature range.

23. A method as set forth in claim 14 wherein said step of solidifying the molten metal in the article mold cavity with an equiaxed grain structure includes solidifying the molten metal in the portion of the metal article where the thick and thin portions are interconnected with the metal substantially free of stress.

24. A method of casting a metal article at least a portion of which is long and thin and has a length which is more than four inches and which is at least twenty times its thickness, said method comprising the steps of forming a mold having an article mold cavity with a long thin portion having a length which is more than four inches and is at least twenty times its thickness, the long thin portion of the mold cavity being free of gating along its length, positioning the mold in a furnace with the longitudinal axis of the long thin portion of the article mold in an upright orientation and with a wall extending around the long thin portion of the article mold, the wall having a length which is at least as great as the length of the long thin portion of the article mold and being spaced apart from an inner side surface of the furnace and the long thin portion of the article mold, heating the mold, said step of heating the mold including radiating heat from the inner side surface of the furnace to an outer side surface of the wall and radiating heat from an inner side surface of the wall to the long thin portion of the mold with open space between the wall and the mold, conducting molten metal into the article mold cavity, said step of conducting molten metal into the article mold cavity including conducting molten metal into the long thin portion of the article mold cavity at a location other than along the length of the long thin portion of the article mold cavity, and solidifying the molten metal in the article mold cavity with an equiaxed grain structure.

25. A method as set forth in claim 24 wherein said step of solidifying the molten metal in the article mold cavity includes radiating heat from the long thin portion of the article mold through an open space to the inner side surface of the wall and radiating heat from the outer side surface of the wall.

26. A method as set forth in claim 25 further including the step of withdrawing the mold from the furnace while performing said step of solidifying the molten metal in the article mold cavity.

27. A method as set forth in claim 24 wherein the metal article has a thick portion connected to the long thin portion of the article and the mold cavity has a thick portion connected with a lower end portion of the long thin portion of the article mold cavity, the wall extending around the thick portion of the article mold with the inner side surface of the wall spaced apart from the thick portion of the mold, said step of heating the mold including the step of radiating heat from the inner side surface of the wall to the thick portion of the mold.

28. A method as set forth in claim 27 wherein said step of conducting molten metal into the article mold cavity includes conducting molten metal through the long thin portion of the article mold cavity into the thick portion of the article mold cavity.

29. A method as set forth in claim 27 wherein said step of solidifying the molten metal in the article mold cavity includes radiating heat from the thick portion of the article mold through an open space to the inner side surface of the wall and radiating heat from the outer side surface of the wall.

30. A method as set forth in claim 29 wherein said step of solidifying the molten metal in the article mold cavity includes completing the solidification of the molten metal in the thick portion of the article mold cavity before completing solidification of the molten metal in the portion of the article mold cavity interconnecting the thick and thin portions of the article mold cavity.

31. A method of casting a metal article at least a portion of which is thick and at least a portion of which is long and thin and has a length which is more than four inches and which is at least twenty times its thickness, said method comprising the steps of forming a mold having an article mold cavity with a thick portion and a long thin portion which extends upwardly from the thick portion and has a length which is more than four inches and is at least twenty times its thickness, the long thin portion of the mold cavity being free of gating along its length, positioning the mold in a furnace with the longitudinal axis of the long thin portion of the article mold in an upright orientation and with a wall extending around at least the thick portion of the article mold and a portion of the long thin portion of the article mold, the wall being spaced apart from an inner side surface of the furnace and the thick and long thin portions of the article mold, heating the mold, conducting molten metal into the article mold cavity, said step of conducting molten metal into the article mold cavity including conducting molten metal into the long thin portion of the article mold cavity at a location other than along the length of the long thin portion of the article mold cavity, at least partially withdrawing the mold from the furnace, said step of withdrawing the mold from the furnace including withdrawing at least the thick portion of the article mold from the furnace, solidifying the molten metal in the article mold cavity with an equiaxed grain structure, radiating heat to the wall from at least the thick portion of the article mold, and radiating heat from the wall to areas outside of the furnace while the thick portion of the article mold is being withdrawn from the furnace.

32. A method as set forth in claim 31 wherein said step of heating the mold includes radiating heat from the inner side surface of the furnace to an outer side surface of the wall and radiating heat from an inner side surface of the wall to the article mold.

33. A method as set forth in claim 31 wherein said step of withdrawing the mold from the furnace includes completely withdrawing the wall from the furnace.

34. A method as set forth in claim 31 wherein the wall has a length which is at least as great as the combined length of the thick and long thin portions of the article mold.

35. A method as set forth in claim 31 wherein said step of conducting molten metal into the article mold cavity includes conducting molten metal through the long thin portion of the article mold cavity into the thick portion of the article mold cavity.

36. A method of casting a metal article, said method comprising the steps of inducing a flow of electrical current in a wall of a furnace chamber, radiating heat from the furnace chamber wall to an outer side surface of a second wall disposed within furnace chamber and spaced from the furnace chamber wall, radiating heat from an inner side surface of the second wall through an open space to a mold structure around which the second wall extends, conducting a flow of metal into the mold structure, thereafter, radiating heat from the mold structure through the open space to the inner side surface of the second wall, radiating heat from the outer side surface of the second wall, and solidifying molten metal in the mold structure with an equiaxed grain structure.

37. A method as set forth in claim 36 further including the step of withdrawing the mold structure and second wall from the furnace chamber, said step of radiating heat from the outer side surface of the second wall including radiating heat to areas outside of the furnace chamber while withdrawing the mold structure and second wall from the furnace chamber.

38. A method as set forth in claim 36 further including the step of supporting the second wall and mold structure with a chill plate, said step of solidifying molten metal in the mold structure including conducting heat from the molten metal to the chill plate.

* * * * *

UNITED STATES PATENT AND TRADEMARK OFFICE

CERTIFICATE OF CORRECTION

PATENT NO. : 5,072,771

DATED : December 17, 1991

INVENTOR(S) : T. V. Rama Prasad

It is certified that error appears in the above-identified patent and that said Letters Patent is hereby corrected as shown below:

Column 29, Line 67, Claim 12, change "form" to --from--.

Signed and Sealed this

Twentieth Day of April, 1993

*Attest:*

MICHAEL K. KIRK

*Attesting Officer*

*Acting Commissioner of Patents and Trademarks*